US007621517B2

(12) United States Patent
Farmer

(10) Patent No.: US 7,621,517 B2
(45) Date of Patent: Nov. 24, 2009

(54) RE-CIRCULATING PAPER ACCUMULATOR

(75) Inventor: Geoffrey A. Farmer, Billericay (GB)

(73) Assignee: Pitney Bowes Ltd., Harlow, Essex (GB)

( * ) Notice: Subject to any disclaimer, the term of this patent is extended or adjusted under 35 U.S.C. 154(b) by 42 days.

(21) Appl. No.: 11/877,050

(22) Filed: Oct. 23, 2007

(65) Prior Publication Data

US 2008/0128977 A1 Jun. 5, 2008

(30) Foreign Application Priority Data

Nov. 30, 2006 (GB) ..... 0623968.5

(51) Int. Cl.
*B65H 33/04* (2006.01)

(52) U.S. Cl. ..... 270/58.01; 270/59; 271/301

(58) Field of Classification Search ..... 271/301; 270/59, 58.01
See application file for complete search history.

(56) References Cited

U.S. PATENT DOCUMENTS

2005/0067748 A1* 3/2005 Fujii et al. ..... 270/58.08

2005/0067777 A1* 3/2005 IIda et al. ..... 271/303

* cited by examiner

*Primary Examiner*—Patrick H Mackey
*Assistant Examiner*—Ernesto Suarez
(74) *Attorney, Agent, or Firm*—Ronald Reichman; Angelo N. Chaclas

(57) ABSTRACT

There is disclosed a sheet re-circulating accumulator (10) comprising: an inlet feed path (20) to an accumulation location (30); an outlet feed path (40); a sheet circulation path (60) defined by stationary sheet guide means (62, 64, 66, 68); and sheet driving means (32, 70, 72, 74, 76) associated with the sheet circulation path (60) for selectively advancing a partial accumulation (P) of one or more sheets (S) at the accumulation location (30) around the sheet circulation path (60), so that the partial accumulation (P) is guided by the stationary sheet guide means (62, 64, 66, 68) at the leading edge of the partial accumulation (P) while being driven, and back to the accumulation location (30) to accumulate the next sheet (S) fed from the inlet feed path (20) with the partial accumulation (P), and delivering an accumulation (A) of sheets (S) along said outlet feed path (40).

12 Claims, 19 Drawing Sheets

RE-CIRCULATING PAPER ACCUMULATOR

CROSS REFERENCE TO RELATED APPLICATIONS

This application claims the benefit of the filling date of Nov. 30, 2006, for United Kingdom application number 0623968.5, which is owned by the assignee of the present application.

FIELD OF THE INVENTION

The present invention relates to a sheet accumulator. Such a sheet accumulator is suitable for use in a sheet handling apparatus, and finds particular application in a paper handling apparatus, such as a mail piece creation device.

BACKGROUND

Many types of paper handling apparatus are known, for manipulating sheets of paper by performing a sequential series of process steps on individual sheets. Such process steps involve transporting, printing, collating, accumulating, folding, etc. In many cases, it is desirable to process a number of individual sheets so as to group a plurality of such sheets together into an ordered bundle. The process of placing such sheets in order is known as collating, while the process of grouping the plurality of sheets into a neat and aligned bundle is known in the art as accumulating. Known devices that might require a mechanism for accumulating a plurality of ordered sheets include printers, faxes, photocopiers, and mail piece creation devices.

Mail piece creation devices have traditionally been the province of very large organizations, such as banks, utility companies and governments, who require an automated system for rapidly producing a large number of mail items for postal delivery to a list of receivers that might include upwards of 1 million of addressees. To achieve this level of production capacity necessitates an industrial-sized complex for producing and handling the vast quantity of individual mail items. These systems are large complex, and typically require a full-time staff of specially trained operators in order to oversee production.

More recently, there has been demand for small and medium-sized mail piece creation apparatuses for use by small and medium sized enterprises (SMEs), on a more modest scale. To meet this demand, "desktop" sized mail piece creation devices have been offered that can be installed and operated relatively easily in an office environment. The size of these machines can vary quite considerably from a floor-standing apparatus that might occupy a small room, to devices that occupy substantially the same amount of space as a typical fax machine or desktop printer. The relative size of the different machines tends to correspond directly to the degree of functionality that they are able to provide, in terms of the number of different paper processing operations that the machine can perform. The size of the machine is also often dictated by the required capacity or throughput, that is, the number of mail pieces that can be created per unit time. For example, as a rule, the larger the machine; the larger the size of documents that can typically be processed; the larger the range of options for accommodating different sizes of paper and envelopes; the larger the number of paper-processing and envelope-handling functions available; and the more documents that can be processed within a given period of time. Nevertheless, since the office space, where the mail creation device is to be installed, is charged at a premium based on the floor area occupied, the driving influence remains towards reducing the size of these mail piece creation devices, while maintaining their throughput capacity and functionality.

One of the limiting factors in reducing the size of such mail piece creation devices is the size of the sheets of paper that are to be handled. The paper must be manipulated so as to be transported through the machine along defined paper paths, without damaging the paper by tearing or creasing, etc. One particular mechanism whose size is limited in this way is the so-called "accumulator". An accumulator receives a plurality of sheets to be formed into an aligned stack. The sheets are typically fed sequentially one-at-a-time into the accumulator, in the desired order (i.e., already collated). The size of the accumulator mechanism has thus, typically, been governed by the size of the stack of sheets to be accumulated.

Further specific considerations also apply when creating a stack of sheets of paper that are intended to be aligned at the edges of the sheets. Precise control is required to prevent the sheet edges from becoming staggered (which is known as shingling). Factors which can affect the ability to align sheets of paper in a stack are, for example, the frictional forces between adjacent sheets of paper, and the frictional force between any driving means used to drive the sheets of paper and those sheets. A precise balance is needed between these two sets of frictional forces in order to drive one sheet relative to an adjacent sheet, as well as when it is desired to transport the fully formed accumulation without losing the alignment between sheets. More specifically, in order to drive one sheet relative to another sheet, it is necessary to apply a frictional force from the driving means which will overcome the frictional forces between the two adjacent sheets. However, the driving force must not be so great that it will either damage the sheet being driven, or cause one or both of the adjacent sheets to become buckled unintentionally. Additionally, when driving an accumulation of sheets formed into a stack, so as to maintain the accumulation as an aligned unitary body, the driving or acceleration forces applied to the stack must not be so great as to overcome the frictional forces between adjacent sheets and the stack. This is apparent, since it is generally only possible to apply a force to the top and bottom sheets in a stack, with the driving force that is applied to any sheets intermediate there between only deriving from the frictional contact between adjacent sheets. Shingling of the stack occurs when these frictional forces are overcome, causing the adjacent sheets to separate and become staggered.

Furthermore, paper to be handled by such mail creation devices must be handled relatively carefully to avoid damaging the paper. For example, if the paper is forced around a bend in a paper path that is too sharp, the paper will become creased, or may adopt a permanently bowed configuration, rather than the desired flat configuration. When attempting to transport paper along a paper feed path, it is necessary either to effectively drag the paper, by applying a pulling force at the front edge of the paper, or to propel the paper along the path, by applying a pushing force to the paper substantially behind the paper leading edge. Where a pushing force is to be employed, in any given paper handling operation, it is necessary to ensure that the force needed to drive the paper against any resistance acting in the opposite direction will not exceed the capacity of the paper to resist buckling under the influence of that driving force and the resistance. Any given sheet of paper has a given column strength, which must be overcome so as to cause the paper to buckle, that is, to bow or bend out of an aligned configuration, i.e. perpendicular to the driving force. In certain paper handling applications, a buckle may be intentionally employed, for example, to effect a paper fold at a desired location. On the other hand, unintentional buckling of paper sheets can lead to either misalignment or creasing of the sheets, which would be undesirable.

One known form of accumulator provides an accumulation chamber, into which sheets are fed sequentially in the order in which they are to be accumulated in the stack. A first sheet is fed into the chamber, and driven against a stop at the end of the chamber. A driving means in the form of a friction belt is provided along one wall of the chamber, to supply the driving force. A subsequent sheet is then fed into the chamber between the driving means and the sheet already stopped in the chamber. The driving means then drives the subsequent sheet into and along the chamber, up to and against the stop, to bring it into alignment with the first sheet already stopped in the chamber. In this arrangement, the friction belt must provide a driving force which will overcome the frictional contact between adjacent sheets as each subsequent sheet is fed into the accumulation chamber and is driven past and against the previous sheet already stopped in the chamber. At the same time, the friction belt must slip relative to any sheets already stopped in the accumulation chamber, so as neither to damage the sheet relative to which it is slipping, nor to cause the sheet to buckle as it is driven against the stop. Once the accumulation has been formed, the stop is removed and the accumulated stack is released to be delivered for further processing.

An alternative form of accumulator, which overcomes the need for any relative motion between adjacent sheets that are to be accumulated, is known as a re-circulating accumulator. Such an accumulator is known from U.S. Pat. No. 6,454,255 A1 to Allen et. al., dated Sep. 24, 2002. This known accumulator is shown in accompanying FIGS. 17 and 18. The re-circulating accumulator in Allen et al. receives sheets of paper 18 that are fed sequentially into the sheet accumulator 10 at an entry point 19. The sheets are fed into gripper jaws 12, situated at a home location 21, until the sheet is pressed against a backstop 20 (see FIG. 17). A sheet so fed is then circulated around a circular device 24 by closing the gripper jaws 12 and dragging the sheet 18 by its leading edge around a circular outer perimeter 22 of the circular device 24. A sheet so circulated lies at rest on the outer perimeter 22 (see FIG. 18), held in place by the inner perimeter 27 of a circular paper guide 29 (shown as dashed lines in FIG. 18). The sheet 18 is dragged around the circular path by rotating the gripper jaws 12 that grip the sheet 18 about an axis that is aligned with the central axis of circular device 24. Subsequently fed sheets entering the entry point 19 are fed into the gripper jaws 12 between an outer jaw 34 and any sheets already forming a stack on the outer perimeter 22 of the device (see FIG. 18). The gripper jaws are circulated once for every sheet 18 fed into the sheet accumulator 10, to accumulate each sheet 18 into the stack of sheets being accumulated. When the last sheet 18 has been fed, gripper jaws 12 are rotated out of the way of the home location 21, thereby freeing the leading edge of the stack of sheets that has been accumulated. A set of driven rollers 52 then drives the stack of sheets out of the sheet accumulator 10 to a set of take away rollers 58, which propel the stack of sheets out of the sheet accumulator 10 for further processing.

SUMMARY OF THE INVENTION

According to a first aspect of the present invention, there is provided a sheet accumulator comprising: an inlet feed path to an accumulation location; an outlet feed path; a sheet circulation path defined by stationary sheet guide means; and sheet driving means associated with the sheet circulation path for selectively advancing a partial accumulation of one or more sheets at the accumulation location around the circulation path, so that the partial accumulation is guided by the stationary sheet guide means at the leading edge of the partial accumulation while being driven, and back to the accumulation location to accumulate the next sheet fed from the inlet feed path with the partial accumulation, and delivering an accumulation of sheets along said outlet feed path.

In preferred embodiments of the first aspect, said sheet driving means includes first and second sheet engaging means located in opposing relation to each other on opposite sides of the circulation path, and being biased relative to each other to effect a pressing engagement between said first and second engaging means. In certain of the preferred embodiments, the first sheet engaging means may comprise a pressing roller that is biased into pressing engagement with the second sheet engaging means; more particularly, the pressing roller may be an idler roller. In certain further preferred embodiments, the first sheet engaging means comprises a plurality of pressing rollers that are biased into pressing engagement with the second sheet engaging means. The second sheet engaging means may comprise a drive roller or a friction belt; in which case, the second sheet engaging means may comprise a plurality of drive rollers corresponding to a plurality of pressing rollers, the pressing rollers being biased into pressing engagement with said drive rollers, to form a plurality of driven roller pairs located along said circulation path.

In further preferred embodiments of the first aspect, said sheet driving means at least partially projects into the sheet circulation path through one or more gaps in the stationary sheet guide means, for engaging the partial accumulation to be driven.

In even further preferred embodiments of the first aspect, said stationary sheet guide means comprises one or more outer fixed guides defining the external limit of travel for the partial accumulation as it is driven along the sheet circulation path; while further or alternatively, said stationary sheet guide means comprises one or more inner fixed guides defining the internal limit of travel for the partial accumulation as it is driven along the sheet circulation path. In these embodiments, each of the fixed guides is formed from sheet metal.

Yet further preferred embodiments of the first aspect comprise sheet aligning means for stopping sheets at the accumulation location, and for substantially aligning the leading edges of sheets simultaneously stopped at the accumulation location. Such a sheet aligning means may comprise a deskew roller pair that is located across the accumulation location and defines a deskew nip between the rollers at the accumulation location, the deskew roller pair, in operation of the sheet aligning means selectively (i) being fixable against rotation, thereby to receive and arrest the leading edges of sheets driven into the deskew nip, with the sheets therein received being further driven so as to cause the leading edges of the sheets to become aligned across the deskew nip, and (ii) being able to rotate, thereby to allow sheets aligned in the deskew nip to advance. Preferably, the deskew roller pair includes at least one drive roller for drivingly advancing sheets aligned in the deskew nip. Moreover, the deskew roller pair may form part of said sheet driving means.

Yet even further preferred embodiments of the first aspect comprise diverter means for selectively diverting sheets advanced from the accumulation location (i) to be delivered to the outlet path, or (ii) to be advanced around the sheet circulation path and back to the accumulation location. This diverter means may be a diverter gate that operates as a movable guide to perform selectively either as a guide defining an entry to the sheet circulation path or as a guide defining part of the outlet feed path, thereby to cause sheets advanced to the gate to take the respective path. Preferably, such embodiments are configured so that, in operation of said sheet accumulator, sheets that are not to be accumulated may be diverted by said diverter means from said inlet feed path to said outlet feed path without being advanced around said sheet circulation path.

In a particular preferred form of embodiments of the first aspect, said inlet feed path is configured to receive a plurality of sheets simultaneously from one or more inlet delivery paths. Most preferably, the number of inlet delivery paths is two.

A further particular preferred form for embodiments of the first aspect is to comprise a control system for controlling the feeding and accumulation of sheets in the accumulator, the control system including: an inlet sensor arranged to detect the arrival of sheets into the sheet accumulator along the inlet feed path; and a circulation sensor arranged to detect when a partial accumulation has been advanced around the circulation path and back to the accumulation location. The control system may be configured to accumulate the next sheet fed from the inlet feed path with a partial accumulation that has been circulated around the circulation path by detecting the arrival of the next sheet at the inlet sensor and the presence of the partial accumulation at the circulation sensor, and to feed the next sheet and advance the partial accumulation so that they arrive simultaneously at the accumulation location to accumulate the next sheet with the partial accumulation. Alternatively, the control system may be configured to accumulate the next sheet fed from the inlet feed path with a partial accumulation that has been circulated around the circulation path by detecting the arrival of the next sheet at the inlet sensor and the presence of the partial accumulation at the circulation sensor, and to feed the next sheet after the partial accumulation has been fully advanced to the accumulation location, and thereafter to accumulate the next sheet with the partial accumulation at the accumulation location.

As a further alternative, the control system may be configured to accumulate the next sheet fed from the inlet feed path with a partial accumulation that has been circulated around the circulation path by detecting the arrival of the next sheet at the inlet sensor and the presence of the partial accumulation at the circulation sensor, and to fully feed the next sheet to the accumulation location before the partial accumulation has been advanced to the accumulation location, and thereafter to accumulate the partial accumulation with the next sheet at the accumulation location.

A yet further particular preferred form for embodiments of the first aspect is to comprise a motor for supplying drive to the sheet driving means for advancing the partial accumulation around the circulation path. Moreover, the accumulator may include a plurality of motors for supplying drive to the sheet driving means.

In the most preferred embodiments of the first aspect, the sheet circulation path is non-circular.

According to a second aspect of the present invention, there is provided a sheet accumulator comprising: an inlet feed path to an accumulation location; an outlet feed path; a non-circular sheet circulation path; and sheet driving means associated with the sheet circulation path for selectively advancing a partial accumulation of one or more sheets at the accumulation location around the circulation path, and back to the accumulation location to accumulate the next sheet fed from the inlet feed path with the partial accumulation, and delivering an accumulation of sheets along said outlet feed path.

In preferred embodiments of the second aspect, said sheet driving means includes first and second sheet engaging means located in opposing relation to each other on opposite sides of the circulation path, and being biased relative to each other to effect a pressing engagement between said first and second engaging means. In certain of the preferred embodiments, the first sheet engaging means may comprise a pressing roller that is biased into pressing engagement with the second sheet engaging means; more particularly, the pressing roller may be an idler roller. In certain further preferred embodiments, the first sheet engaging means comprises a plurality of pressing rollers that are biased into pressing engagement with the second sheet engaging means. The second sheet engaging means may comprise a drive roller or a friction belt; in which case, the second sheet engaging means may comprise a plurality of drive rollers corresponding to a plurality of pressing rollers, the pressing rollers being biased into pressing engagement with said drive rollers, to form a plurality of driven roller pairs located along said circulation path.

Further preferred embodiments of the second aspect comprise sheet aligning means for stopping sheets at the accumulation location, and for substantially aligning the leading edges of sheets simultaneously stopped at the accumulation location. Such a sheet aligning means may comprise a deskew roller pair that is located across the accumulation location and defines a deskew nip between the rollers at the accumulation location, the deskew roller pair, in operation of the sheet aligning means selectively (i) being fixable against rotation, thereby to receive and arrest the leading edges of sheets driven into the deskew nip, with the sheets therein received being further driven so as to cause the leading edges of the sheets to become aligned across the deskew nip, and (ii) being able to rotate, thereby to allow sheets aligned in the deskew nip to advance.

Preferably, the deskew roller pair includes at least One drive roller for drivingly advancing sheets aligned in the deskew nip. Moreover, the deskew roller pair may form part of said sheet driving means.

Even further preferred embodiments of the second aspect comprise diverter means for selectively diverting sheets advanced from the accumulation location (i) to be delivered to the outlet path, or (ii) to be advanced around the sheet circulation path and back to the accumulation location. This diverter means may be a diverter gate that operates as a movable guide to perform selectively either as a guide defining an entry to the sheet circulation path or as a guide defining part of the outlet feed path, thereby to cause sheets advanced to the gate to take the respective path. Preferably, such embodiments are configured so that, in operation of said sheet accumulator, sheets that are not to be accumulated may be diverted by said diverter means from said inlet feed path to said outlet feed path without being advanced around said sheet circulation path.

In yet further preferred embodiments of the second aspect, said inlet feed path is configured to receive a plurality of sheets simultaneously from one or more inlet delivery paths. Most preferably, the number of inlet delivery paths is two.

Yet even further preferred embodiments of the second aspect comprise a control system for controlling the feeding and accumulation of sheets in the accumulator, the control system including: an inlet sensor arranged to detect the arrival of sheets into the sheet accumulator along the inlet feed path; and a circulation sensor arranged to detect when a partial accumulation has been advanced around the circulation path and back to the accumulation location. The control system may be configured to accumulate the next sheet fed from the inlet feed path with a partial accumulation that has been circulated around the circulation path by detecting the arrival of the next sheet at the inlet sensor and the presence of the partial accumulation at the circulation sensor, and to feed the next sheet and advance the partial accumulation so that they arrive simultaneously at the accumulation location to accumulate the next sheet with the partial accumulation. Alternatively, the control system may be configured to accumulate the next sheet fed from the inlet feed path with a partial accumulation that has been circulated around the circulation path by detecting the arrival of the next sheet at the inlet sensor and the presence of the partial accumulation at the circulation sensor, and to feed the next sheet after the partial accumulation has been fully advanced to the accumulation location, and thereafter to accumulate the next sheet with the partial accumulation at the accumulation location. As a further alternative, the control system may be configured to accumulate the next sheet fed from the inlet feed path with a partial accumulation that has been circulated around the circulation path by detecting the arrival of the next sheet at the inlet sensor and the presence of the partial accumulation at the circulation sensor, and to fully feed the next sheet to the accumulation location before the partial accumulation has been advanced to the accumulation location, and thereafter to accumulate the partial accumulation with the next sheet at the accumulation location.

Still further preferred embodiments of the second aspect comprise a motor for supplying drive to the sheet driving means for advancing the partial accumulation around the circulation path. This may include a plurality of motors for supplying drive to the sheet driving means.

Embodiments of the invention provide a sheet accumulator configuration that is adaptable to a suitable shape so as to fit conveniently within a sheet handling apparatus into which the accumulator is to be installed. More particularly, the sheet accumulator is not constrained to the use of a circulation path that is circular in cross-section. The sheet circulation path can thus be shaped appropriately, either to reduce the overall volume occupied by the sheet accumulator or to beneficially adapt the shape of the circulation path so as to fit in between and around adjacent components within the sheet handling apparatus into which the sheet accumulator is to be installed. This provides the designer of a paper handling apparatus incorporating such a sheet accumulator with a greater degree of design freedom for incorporating the sheet circulation path into the device, and can advantageously allow the overall size of such a device to be reduced.

Further advantages achievable with embodiments of the present invention will be discussed in conjunction with the description which follows.

BRIEF DESCRIPTION OF THE DRAWINGS

To enable a better understanding of the present invention, and to show how the same may be carried into effect, reference will now be made, by way of example only, to the accompanying drawings, in which.

Figure 17:
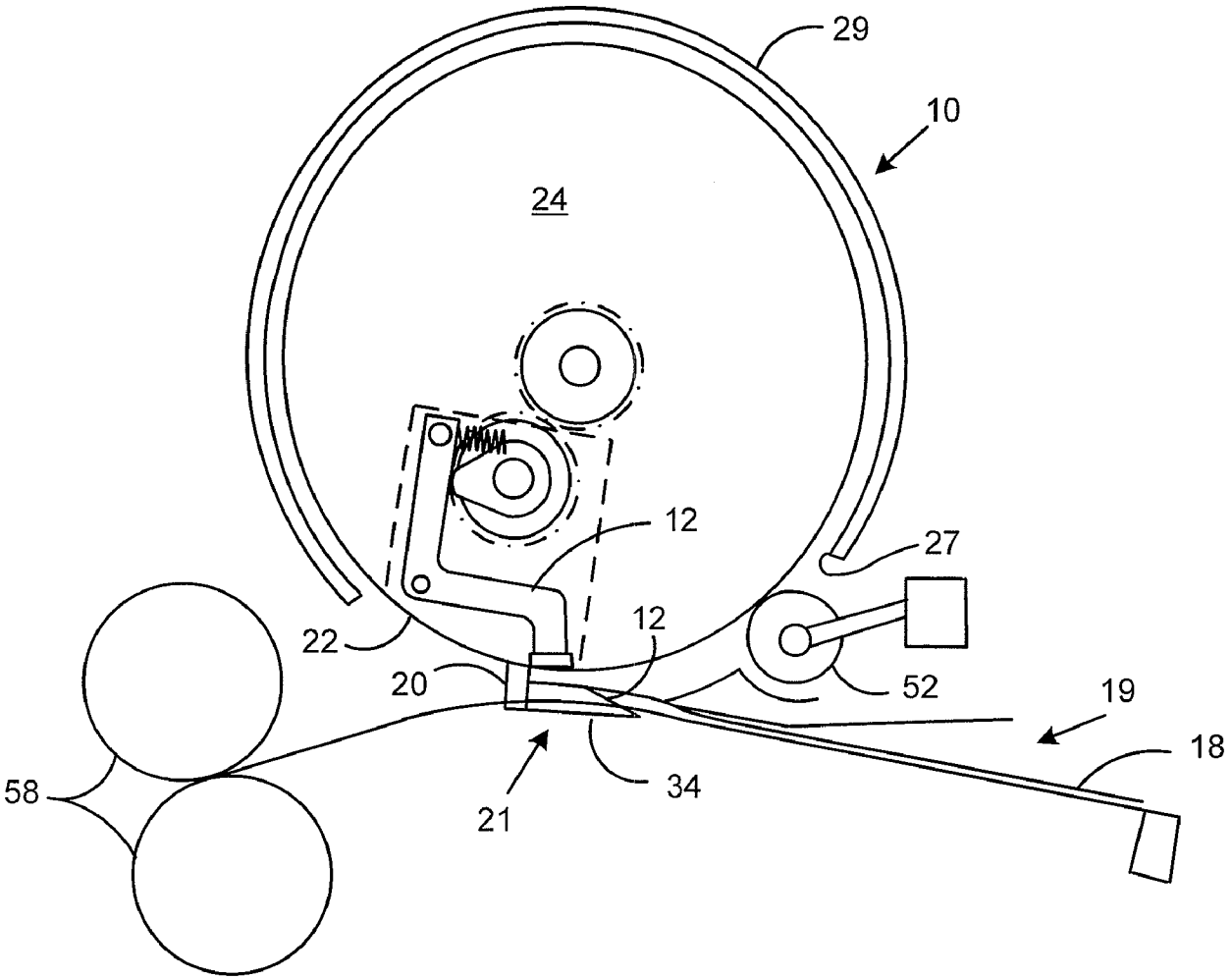
FIG. 17 (PRIOR ART)
FIG. 17 and FIG. 18 are cross-sectional schematic views of a prior art re-circulating accumulator.
Figure 18:
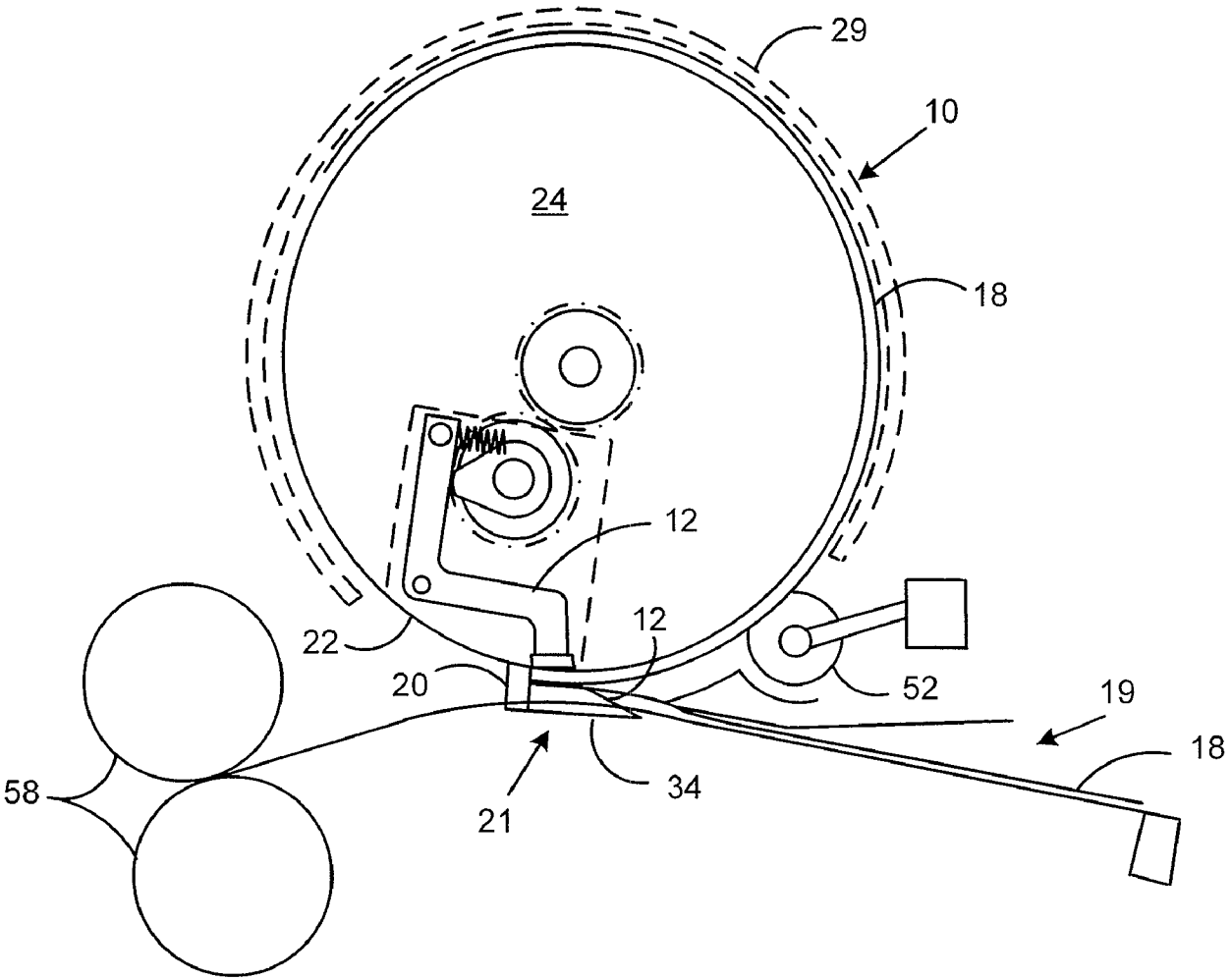
FIG. 18 (PRIOR ART)

In drawings FIGS. 1-16 and 16A, like reference numerals refer to the same or like components of the re-circulating apparatus. On the other hand, the reference numerals in FIGS. 17 and 18 are the reference numerals originally used in the prior art publication, and do not correspond with the reference numerals used in the following detailed description.

DETAILED DESCRIPTION

Figure 1:
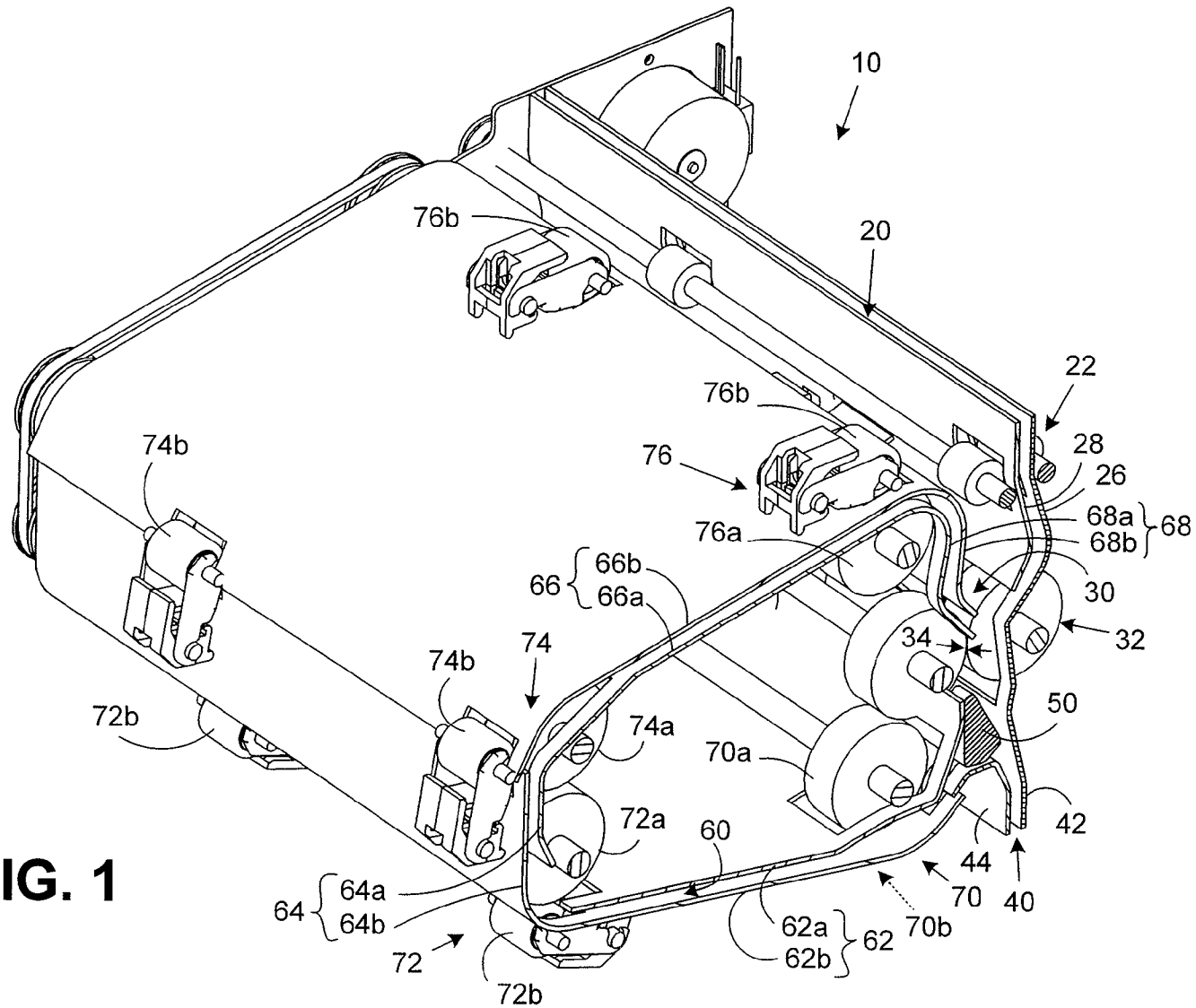
FIG. 1 is a sectional perspective view of the main components of a first embodiment of a re-circulating accumulator in accordance with the present invention.

FIG. 1 is a three-dimensional view of a re-circulating accumulator, showing the main paper-handling components of the device.

Figure 2:
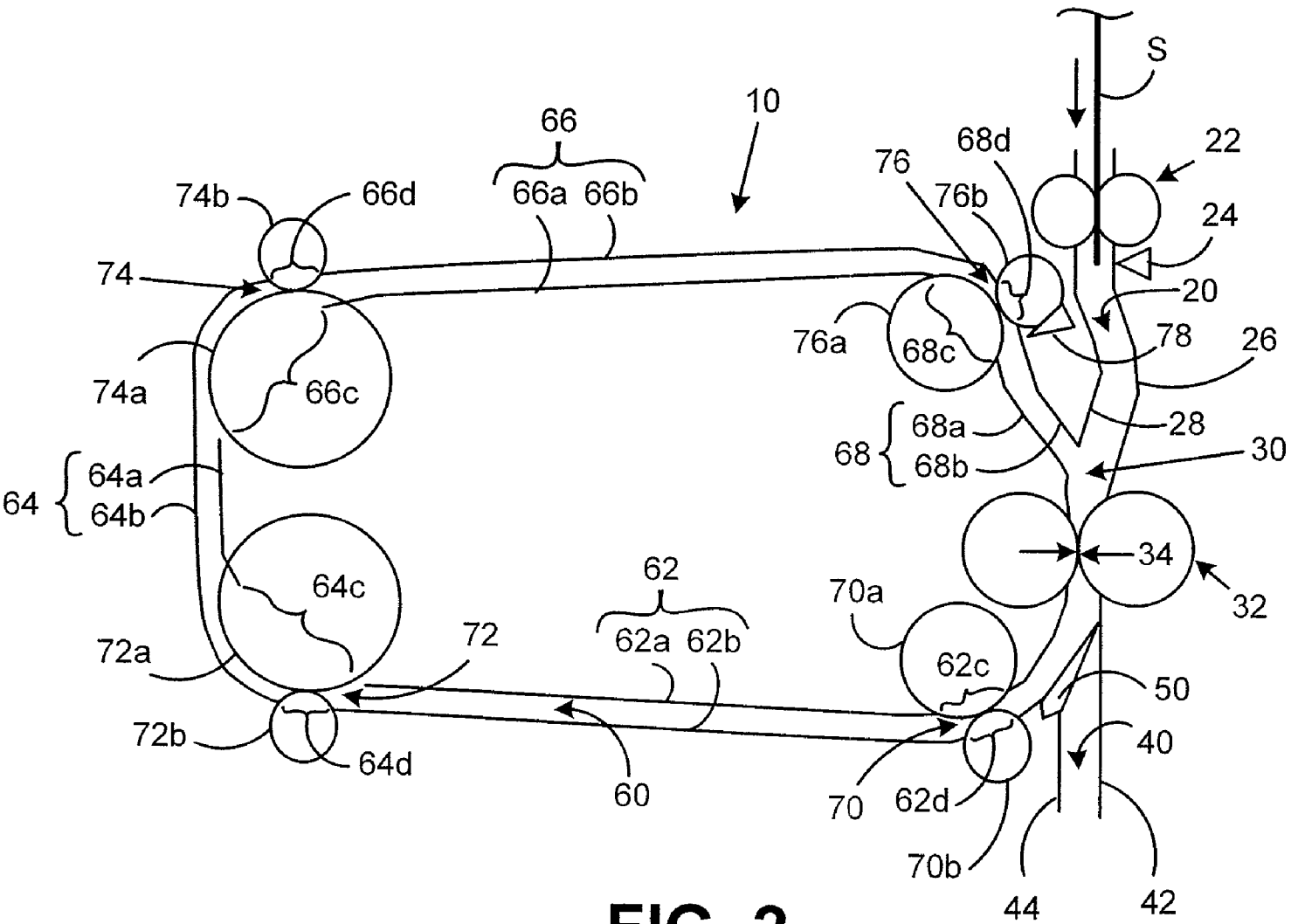
FIG. 2 is a cross-sectional schematic view of the re-circulating accumulator of FIG. 1, showing entry of a first sheet into the re-circulating accumulator.

The re-circulating accumulator 10 includes an inlet feed path 20, along which sheets, in particular sheets of paper, are fed into the re-circulating accumulator 10 to an accumulation location 30. The inlet feed path 20 is provided with an inlet roller pair 22. The inlet roller pair 22 may be driven, for feeding sheets along the inlet feed path, or may be configured as a pair of stopping rollers, for arresting sheets immediately prior to their entry into the re-circulating accumulator 10. This allows the entry of sheets along inlet feed path 20 to be timed in accordance with the desired mode of operation of the re-circulating accumulator 10. Of course, the inlet roller pair 22 may be a driven roller pair for feeding sheets as well as being able to provide the function of arresting sheets on entry into the re-circulating accumulator 10. As shown in FIG. 2, the inlet feed path 20 is also provided with an inlet sensor 24 in the region of the inlet roller pair 22, to detect the arrival of a sheet S fed into the re-circulating accumulator 10 along the inlet feed path 20. FIG. 2 shows a sheet S as it is fed into the re-circulating accumulator 10 along the inlet feed path 20, through inlet roller pair 22, and is detected by inlet sensor 24.

Inlet feed path 20 is defined on either side by an outer inlet path fixed guide 26 and an inner inlet path fixed guide 28. Here, the reference "inner" and "outer" refers to the comparative distance of each guide from the centre of the re-circulating accumulator 10.

The inlet feed path 20 feeds to an accumulation location 30, where sheets to be accumulated in the re-circulating accumulator 10 become accumulated together. The accumulation location 30 is provided with a deskew roller pair 32, which defines a deskew nip 34 between the two rollers. The deskew roller pair 32 is provided across the accumulation location 30, with one deskew roller on either side of the accumulation location, and having the deskew nip 34 arranged within the bounds of the accumulation location 30. Deskew roller pair 32 is preferably formed as a pair of driven rollers that may be selectively fixed against rotation, so as to arrest sheets fed into the accumulation location, and may be selectively driven, so as to advance sheets out of the accumulation location 30.

Beyond the accumulation location 30, in a sheet feeding direction, there is provided a diverter gate 50. The diverter gate 50 selectively directs sheets fed from the accumulation location 30 either along an outlet feed path 40, or into a sheet circulation path 60.

Outlet feed path 40 is defined by an outer outlet path fixed guide 42 and an inner outlet path fixed guide 44, similarly to the inlet feed path. Outlet feed path 40 delivers sheets fed there along out of the re-circulating accumulator 10, as a completed accumulation A. Typically, an accumulation (stack of sheets) A fed along the outlet feed path will be delivered to a subsequent paper processing mechanism, for further paper handling.

Sheets not delivered along the outlet feed path 40 are directed into the sheet circulation path 60 as a partial accumulation P. Sheet circulation path 60, as shown in FIGS. 1 and 2, forms a circuit extending substantially from the accumulation location 30 in a loop substantially all of the way back to the accumulation location 30. The sheet circulation path 60 is defined on both sides by fixed guides. In the particular embodiment shown in FIGS. 1 and 2, the sheet circulation path comprises circulation inlet fixed guides 62 at the inlet to the sheet circulation path; circulation bend fixed guides 64 in the region where sheets that are advanced along the sheet circulation path 60 are directed in a return direction back to the accumulation location 30; circulation return fixed guides 66 which define a return path from the bend section back toward the sheet accumulation location 30; and circulation outlet fixed guides 68 that lead from the circulation return path back to the accumulation location 30. The inlet, bend, return and outlet portions of the circulation path together define the loop of the sheet circulation path 60. Each set of fixed sheet guides 62, 64, 66, 68 includes a respective inner fixed guide 62*a*, 64*a*, 66*a* and 68*a*, defining the most inward extent of travel of sheets of paper in the partial accumulation P towards the centre of the re-circulating accumulator 10, and a respective outer fixed guide 62*b*, 64*b*, 66*b* and 68*b*, defining the outer-most extent of travel of the sheets of paper in the partial accumulation P away from the centre of the re-circulating accumulator 10.

The re-circulating accumulator 10 is further provided with driving means, for advancing sheets of paper around the sheet circulation path 60. In the illustrated embodiment, the driving means includes a plurality of driven roller pairs, 70, 72, 74 and 76. Each roller pair 70, 72, 74 and 76 includes a drive roller 70*a*, 72*a*, 74*a* and 76*a*, respectively, arranged in a mutually opposing manner with a corresponding idler roller 70*b*, 72*b*, 74*b* and 76*b*, respectively. Each of the biased idler rollers 70*b*, 72*b*, 74*b* and 76*b* is biased into pressing engagement with the corresponding drive roller 70*a*, 72*a*, 74*a* and 76*a*, respectively, so as to form a nip that lies in the sheet circulation path 60. Each roller pair is configured to pressingly engage a partial accumulation P received there between, to impart a driving force to such a partial accumulation P, to thereby advance the partial accumulation P as a unitary body around the sheet circulation path 60. The pressing force imparted by the biased idler rollers 70*b*, 72*b*, 74*b* and 76*b* on the respective drive rollers 70*a*, 72*a*, 74*a* and 76*a* must be sufficient to create a frictional force between adjacent sheets S in the partial accumulation P that will prevent shingling of the partial accumulation P as it is advanced. Likewise, the imparted force must be sufficient to ensure that the drive rollers 70*a*, 72*a*, 74*a* and 76*a* gain purchase on the sheet S in the partial accumulation P against which they contact, so as to advance the partial accumulation P without slipping or damaging the sheet.

As shown in FIGS. 1 and 2, the drive rollers 70*a*, 72*a*, 74*a* and 76*a* are positioned at the locations of bends in the sheet circulation path 60, to help drive a partial accumulation P of sheets S around each of the bend locations. Drive rollers 70*a* and 76*a*, which are at areas of relatively low curvature along the sheet circulation path, are of a lesser diameter, and maintain contact with the partial accumulation along a comparatively smaller portion of their circumference, resulting in a reduced contact area between these rollers and the stack of sheets S in the partial accumulation P. Rollers 72*a* and 74*a*, on the other hand, are of relatively larger diameter and maintain contact with the sheets in the partial accumulation P around a relatively larger portion of their circumference, i.e. have a larger driving contact area. This is preferable, since the larger rollers are configured to drive the partial accumulation P around tighter (higher curvature) bends in the sheet circulation path 60, where the risk of slipping and shingling is increased. Of course, it is not necessary for the biased rollers 70*b*, 72*b*, 74*b* and 76*b* to be idler rollers, i.e. undriven, and they may equally be formed as corresponding drive rollers, to drive the partial accumulation P in cooperation with the drive rollers 70*a*, 72*a*, 74*a* and 76*a*. This can help to further reduce the effects of shingling in a partial accumulation P, by providing drive to both the top and bottom sheets S stacked in the partial accumulation P.

As shown in FIGS. 1 and 2, each roller pair 70, 72, 74 and 76 is configured to extend at least partially into the sheet circulation path 60, to thereby engage and provide driving force to a partial accumulation P. The roller pairs 70, 72, 74 and 76 extend into the sheet circulation path through gaps

62*c*, 62*d*, 64*c*, 64*d*, 66*c*, 66*d*, 68*c* and 68*d* in or between the fixed sheet guides 62, 64, 66 and 68.

As shown in FIG. 1, although each of the rollers has been referred to as a single "roller", this may, in fact, be realized in a working embodiment as a plurality of individual roller portions mounted on a common roller shaft. Accordingly, the use of the terms "roller" and "guide" in the singular refer to the location of these various components around the sheet circulation path 60, as shown in cross-sectional view in FIGS. 2-16 of the accompanying drawings, for ease of understanding. It should be recognized that each individual roller referred to may in fact be constituted as a plurality of rollers, mounted on a single shaft or a plurality of concentrically aligned shafts, while the guides may each be constituted as a single fixed guide, as shown in FIG. 1, or could be formed of a plurality of guiding portions configured to retain a partial accumulation within the bounds of the sheet circulation path 60. While it is presently contemplated that the fixed guides would be formed as plates of sheet metal, they could equally be formed as simple runners of any suitable material that will allow a sliding interaction with the sheets S in a partial accumulation P to be fed between the guides. As for the various rollers 70*a*, 70*b*, 72*a*, 72*b*, 74*a*, 74*b*, 76*a* and 76*b*, as well as the rollers of the deskew roller pair 32 and inlet roller pair 22, these may be made of any suitable material commonly known in the art. Typically, these rollers will be of a rubberized material to provide a strong frictional interaction with the sheets S.

Figure 14:
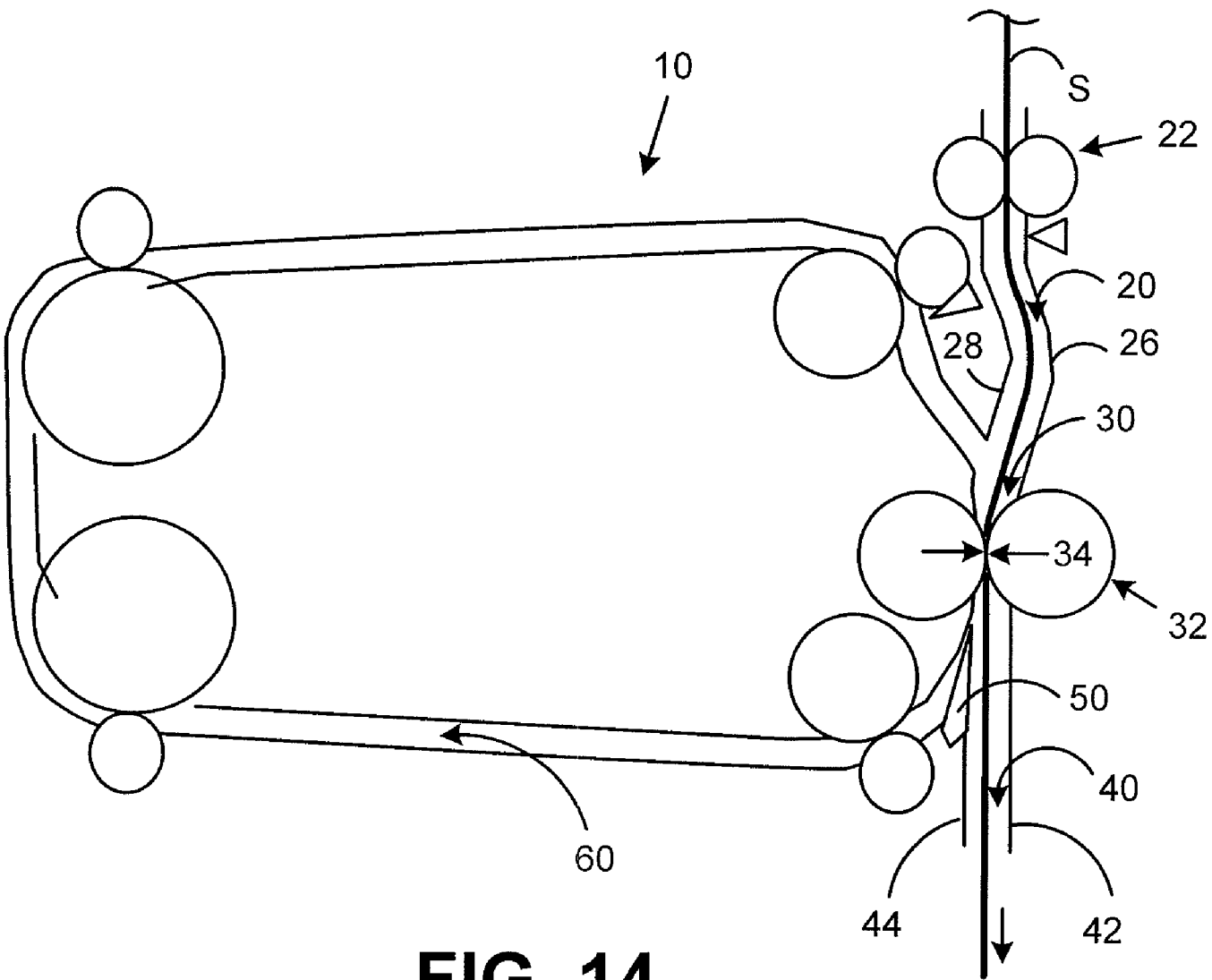
FIG. 14 is a cross-sectional schematic view of the re-circulating accumulator of FIG. 1, showing a single sheet being fed from the inlet feed path to be delivered along the outlet feed path, so as to bypass the sheet circulation path.
Figure 15:
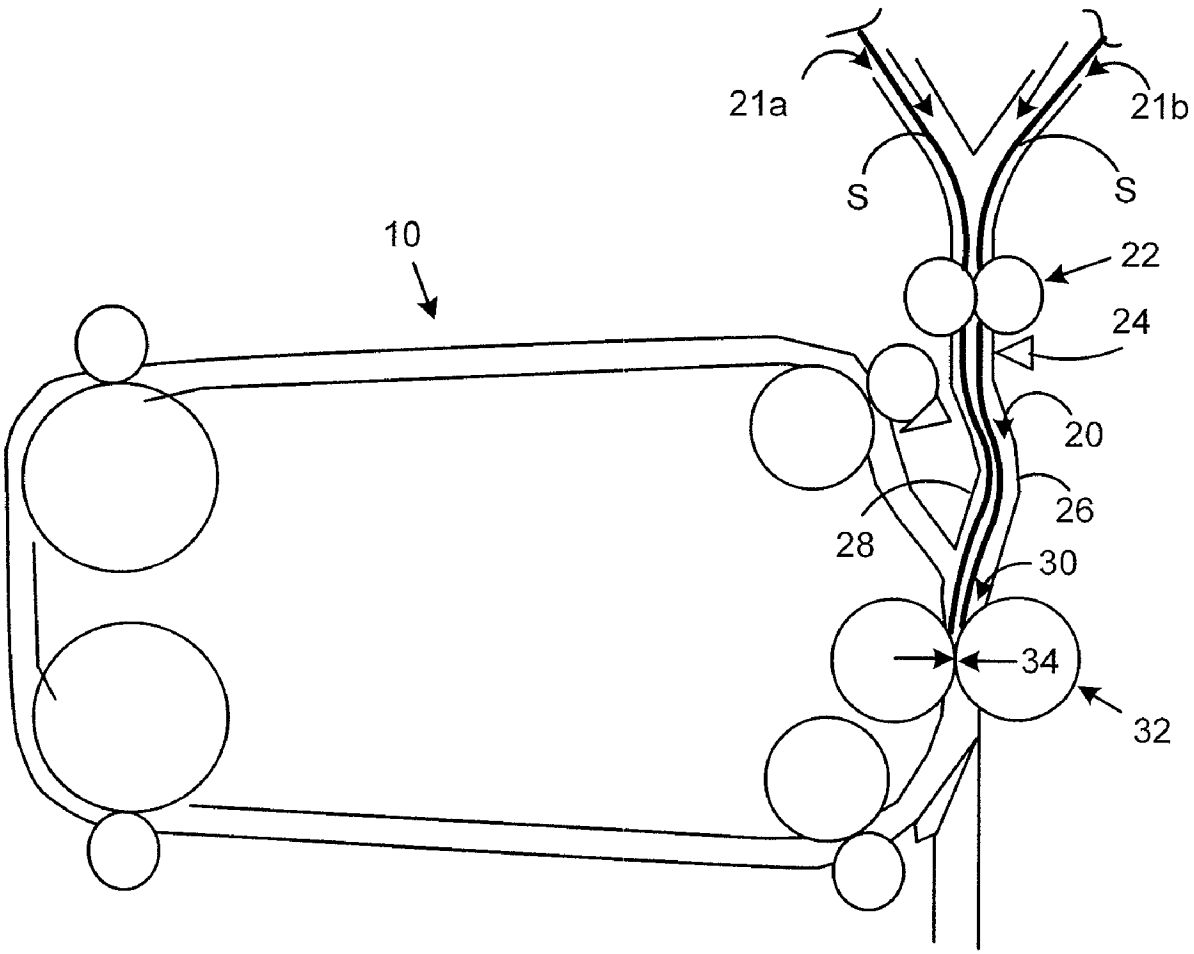
FIG. 15 is a cross-sectional schematic view showing an alternative embodiment of the re-circulating accumulator, similar to the embodiment of FIG. 1, having two inlet delivery paths for feeding two sheets simultaneously into the inlet feed path.

Operation of the re-circulating accumulator 10 will now be described with reference to FIGS. 2-15. FIGS. 2-14 show cross-sectional schematic views of the re-circulating accumulator 10 according to several modes of operation. FIG. 15 shows a cross-sectional schematic view of the re-circulating accumulator 10 when modified to receive a plurality of sheets S simultaneously along the inlet feed path 20 from two separate inlet delivery paths 21*a* and 21*b*. The operation of the re-circulating accumulator of FIG. 15 is otherwise in accordance with the operation of the re-circulating accumulator in FIGS. 2-14, which shall be described herein below.

Figure 3:
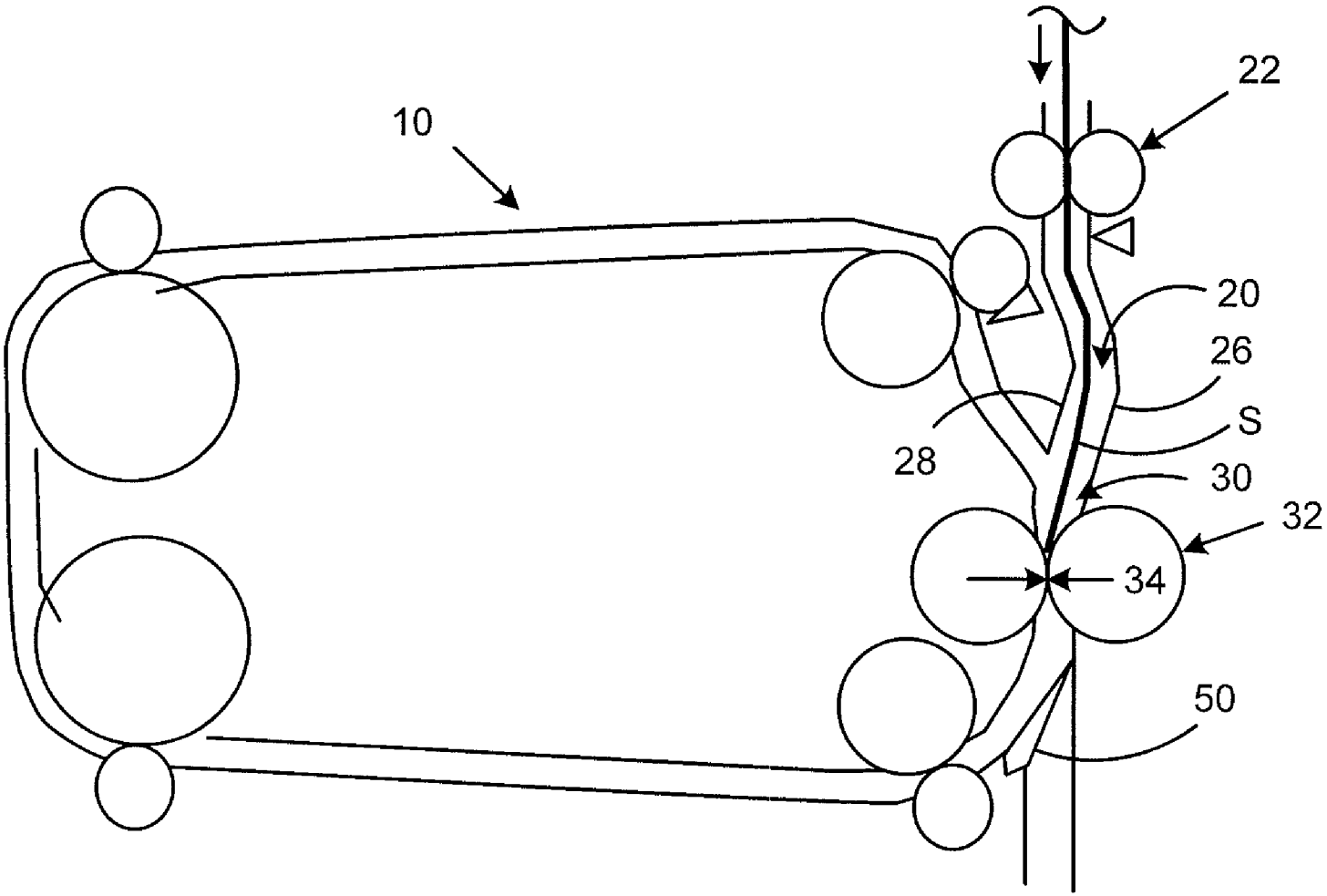
FIG. 3 is a cross-sectional schematic view of the re-circulating accumulator of FIG. 1, showing the first sheet arriving at the accumulation location.

In a first mode of operation, a first sheet S is fed into the re-circulating accumulator 10 along the inlet feed path 20. Sheet S is fed between inlet roller pair 22, and detected by inlet sensor 24. In this mode of operation, the first sheet S is not halted at the inlet roller pair, but is further fed along the inlet feed path 20, as illustrated in FIG. 3. As shown in FIG. 3, the first sheet S is fed so that its leading edge enters the deskew nip 34 between deskew roller pair 32. Deskew roller pair 32 are fixed against rotation, thereby arresting the leading edge of first sheet S in the deskew nip 34. As indicated by the half arrow in FIG. 3, sheet S is further fed after its leading edge arrives in the deskew nip 34, so as to create a buckle in the paper. In preferred embodiments, as shown in FIG. 3, the inner inlet path fixed guide 28 and outer inlet path fixed guide 26 are formed so as to promote buckling of sheet S in a predetermined direction perpendicular to the feed direction of the sheet. As sheet S is driven against the deskew roller pair 32, the formation of a buckle causes the leading edge of the sheet S to be driven into the deskew nip 34, and to become aligned along the deskew nip 34. Accordingly, if the sheet S has been driven along the inlet feed path in a skewed or unaligned fashion, so that the leading edge is not aligned perpendicular to the feeding direction of the sheet S, it will become aligned at the leading edge by the deskew nip 34.

Figure 4:
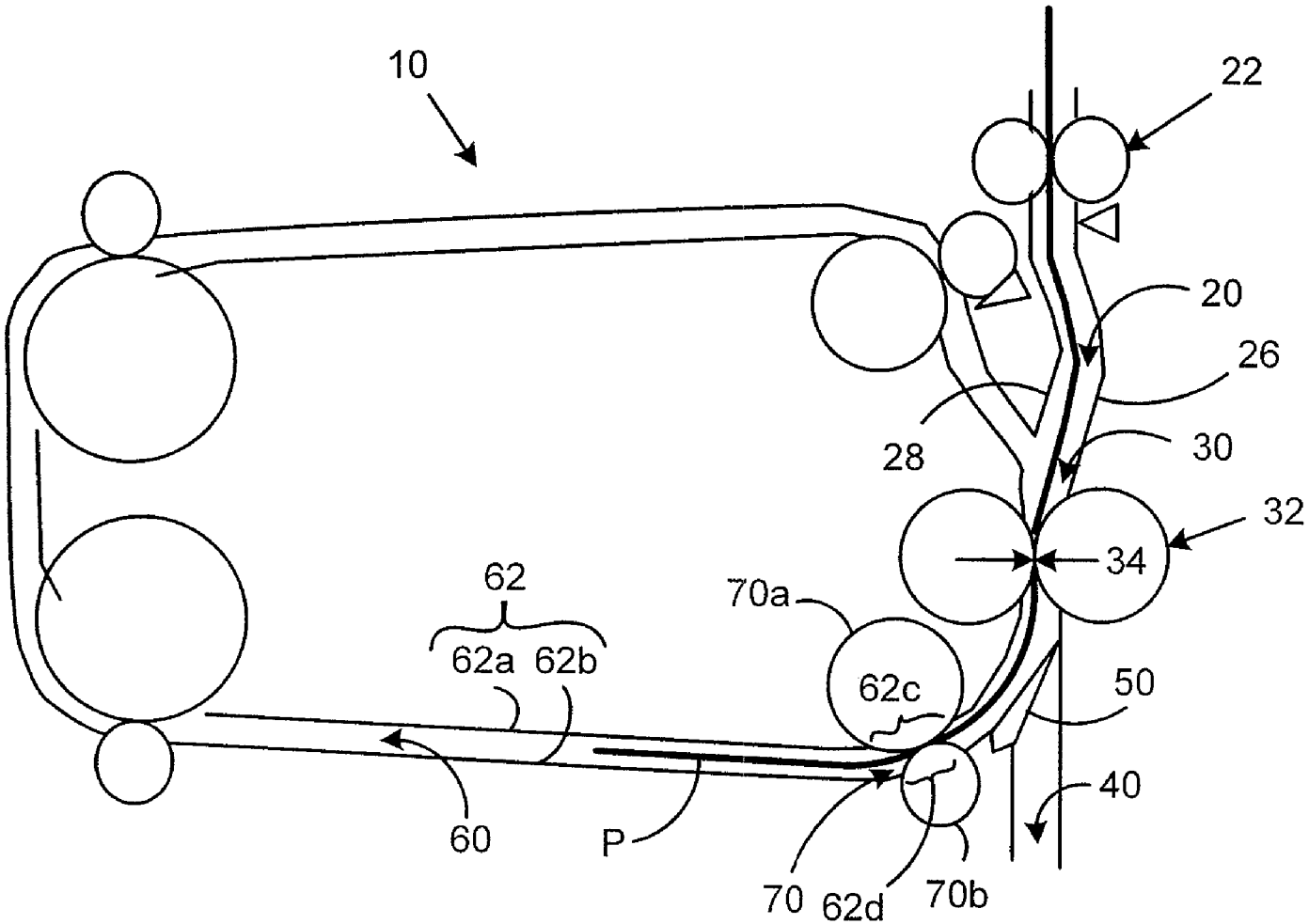
FIG. 4 is a cross-sectional schematic view of the re-circulating accumulator of FIG. 1, showing the first sheet being fed into the sheet circulation path of the re-circulating accumulator.

As shown in FIG. 4, the aligned sheet is then advanced through the deskew roller pair 32. In order to divert the sheet around the sheet circulation path 60, diverter gate 50 is set to block entrance into the outlet feed path 40. In the present embodiment, sheet S is driven into the sheet circulation path 60 by the deskew roller pair 32 driving, to thereby advance the sheet leading edge against the diverter gate 50 and into the sheet circulation path. The sheet leading edge then enters the roller nip between driven roller pair 70 at the inlet portion of the sheet circulation path 60. Once it has entered the sheet circulation path 60, sheet S is considered as a partial accumulation P, i.e. a stack, of one or more sheets S.

Figure 5:
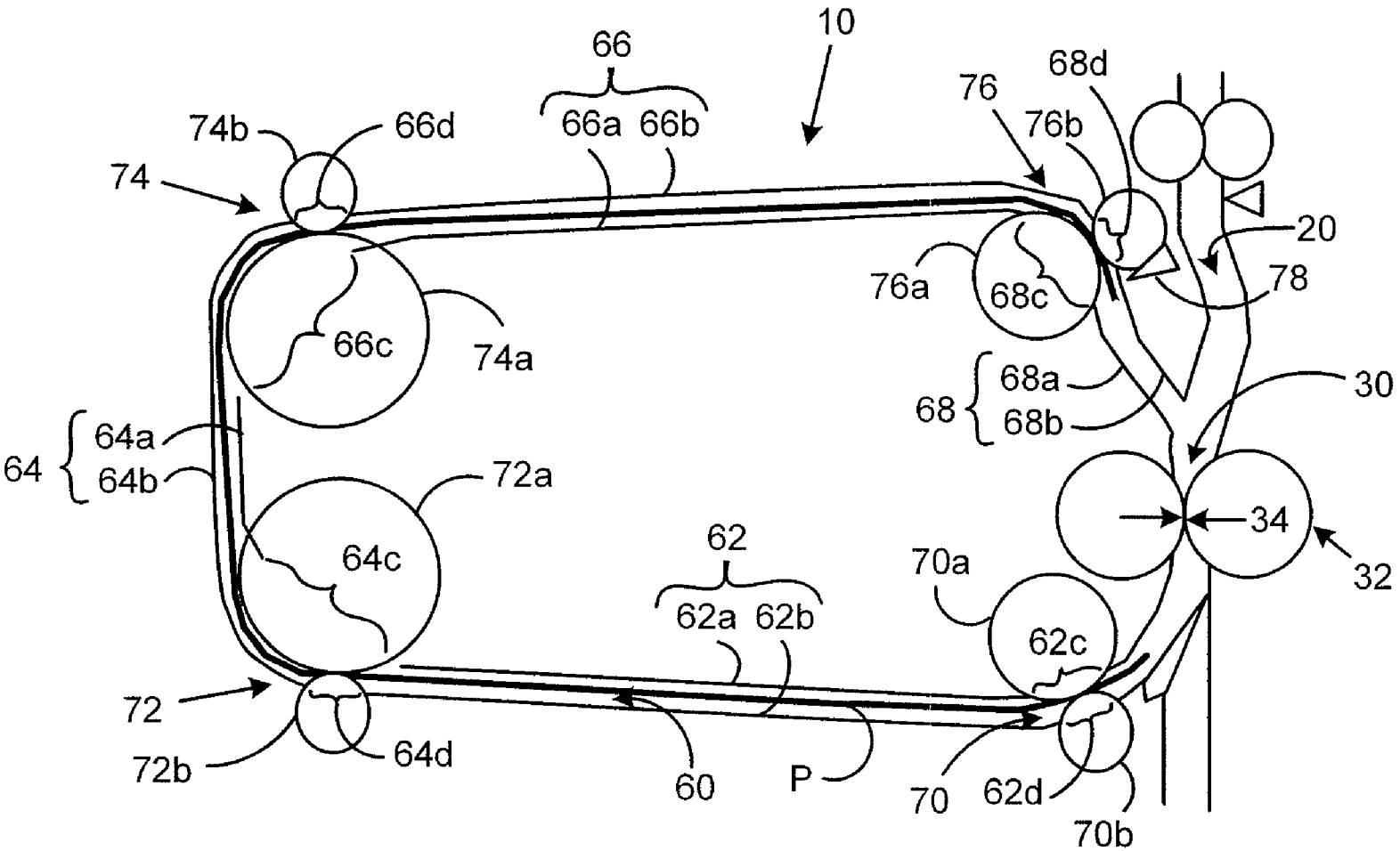
FIG. 5 is a cross-sectional schematic view of the re-circulating accumulator of FIG. 1, showing the first sheet having been substantially fully circulated around the sheet circulation path, with the sheet leading edge being detected by the circulation sensor.

As seen by comparison of FIGS. 4 and 5, the partial accumulation P is advanced around the sheet circulation path 60 by the driven roller pairs 70, 72, 74 and 76, until it has been driven substantially entirely around the sheet circulation path 60. The driven roller pairs 70, 72, 74 and 76 advance the partial accumulation P by driving against the upper and/or lower surfaces of the stack of sheets 5, to drive the partial accumulation P forward by a pushing motion. The fixed sheet guides 62, 64, 66 and 68 constrain the partial accumulation to follow the sheet circulation path 60 by guiding the leading edge of the partial accumulation P as it is advanced in the sheet feeding direction. Put another way, the driven roller pairs 70, 72, 74 and 76 provide only modest, if any, guiding function, and act merely to advance the partial accumulation P in the direction that is mutually tangential to both rollers in the respective drive roller and idler roller pairs 70*a*, 70*b*; 72*a*, 72*b*; 74*a*, 74*b*; and 76*a*, 76*b*. Thus, the partial accumulation P is guided by the fixed sheet guides 62, 64, 66 and 68 by its leading edge, to follow the sheet circulation path 60, while the fixed sheet guides 62, 64, 66 and 68 further constrain the stack of sheets 5 in the partial accumulation P to remain as a grouped stack of sheets between the inner 62*a*, 64*a*, 66*a*, 68*a* and outer 62*b*, 64*b*, 66*b* and 68*b* fixed guides.

It is a matter of preference exactly how the driven roller pairs 70, 72, 74 and 76 are to be configured for driving the partial accumulation P. One possibility is that all of the driven roller pairs 70, 72, 74, 76 are driven constantly and simultaneously so as to jointly advance the partial accumulation P. On the other hand, it is possible that the driving/advancing operation is conducted only by a single driven roller pair at anyone time, so that the partial accumulation P is initially driven by driven roller pair 70 until it reaches driven roller pair 72, at which point driven roller pair ceases to provide any driving action and the partial accumulation P is driven only by driven roller pair 72. The drive is then transferred, similarly, as the leading edge of the partial accumulation P arrives at the nip between each subsequent driven roller pair 74 and 76. When the partial accumulation P has been driven substantially fully around the sheet circulation path 60, as shown in FIG. 5, it is detected by circulation sensor 78. At this point, there are several alternatives for accumulating the partial accumulation P with subsequent sheets S to be delivered to the re-circulating accumulator 10.

Figure 6:
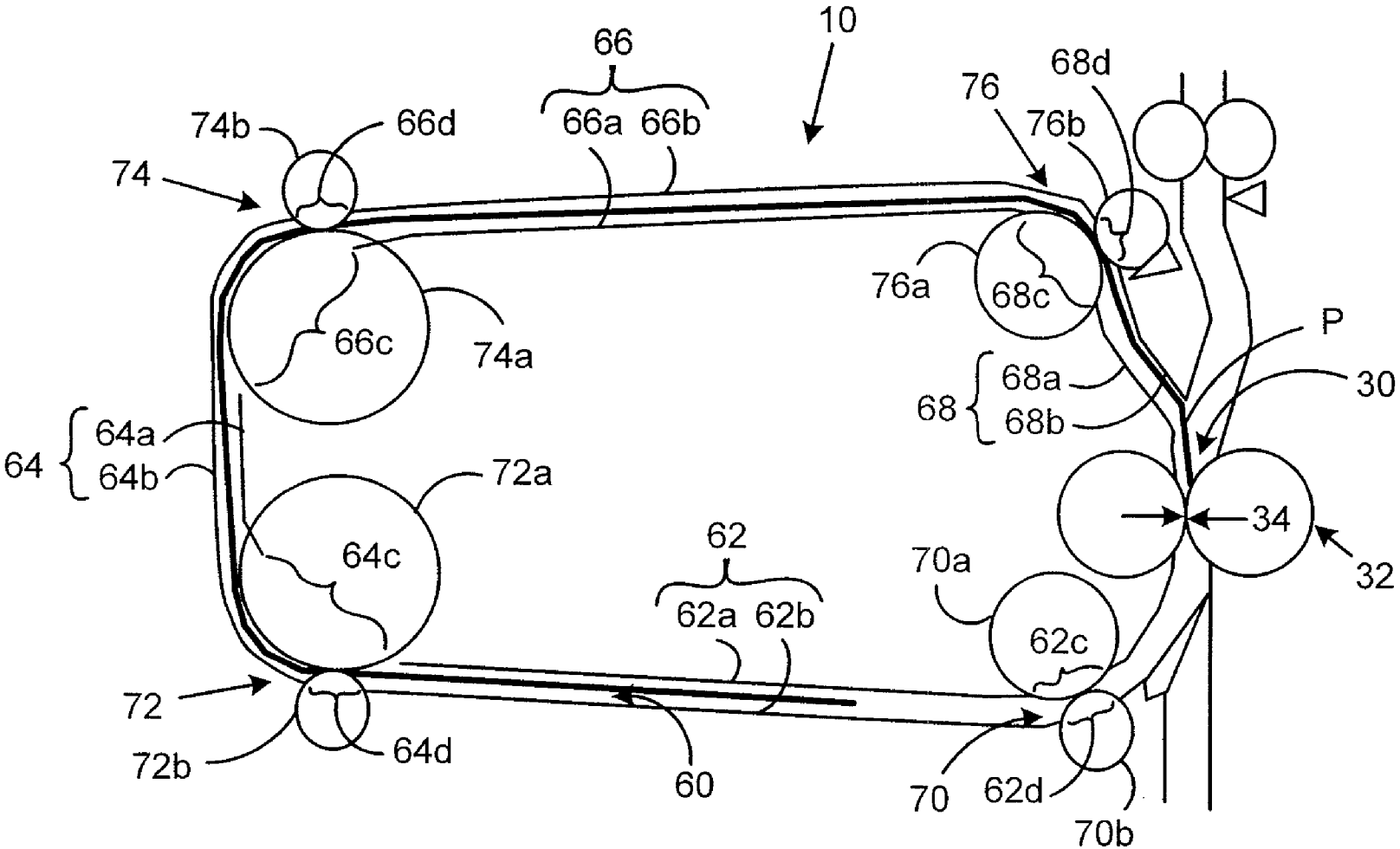
FIG. 6 is a cross-sectional schematic view of the re-circulating accumulator of FIG. 1, showing the first sheet having been fully advanced around the sheet circulation path and back to the accumulation location.
Figure 7:
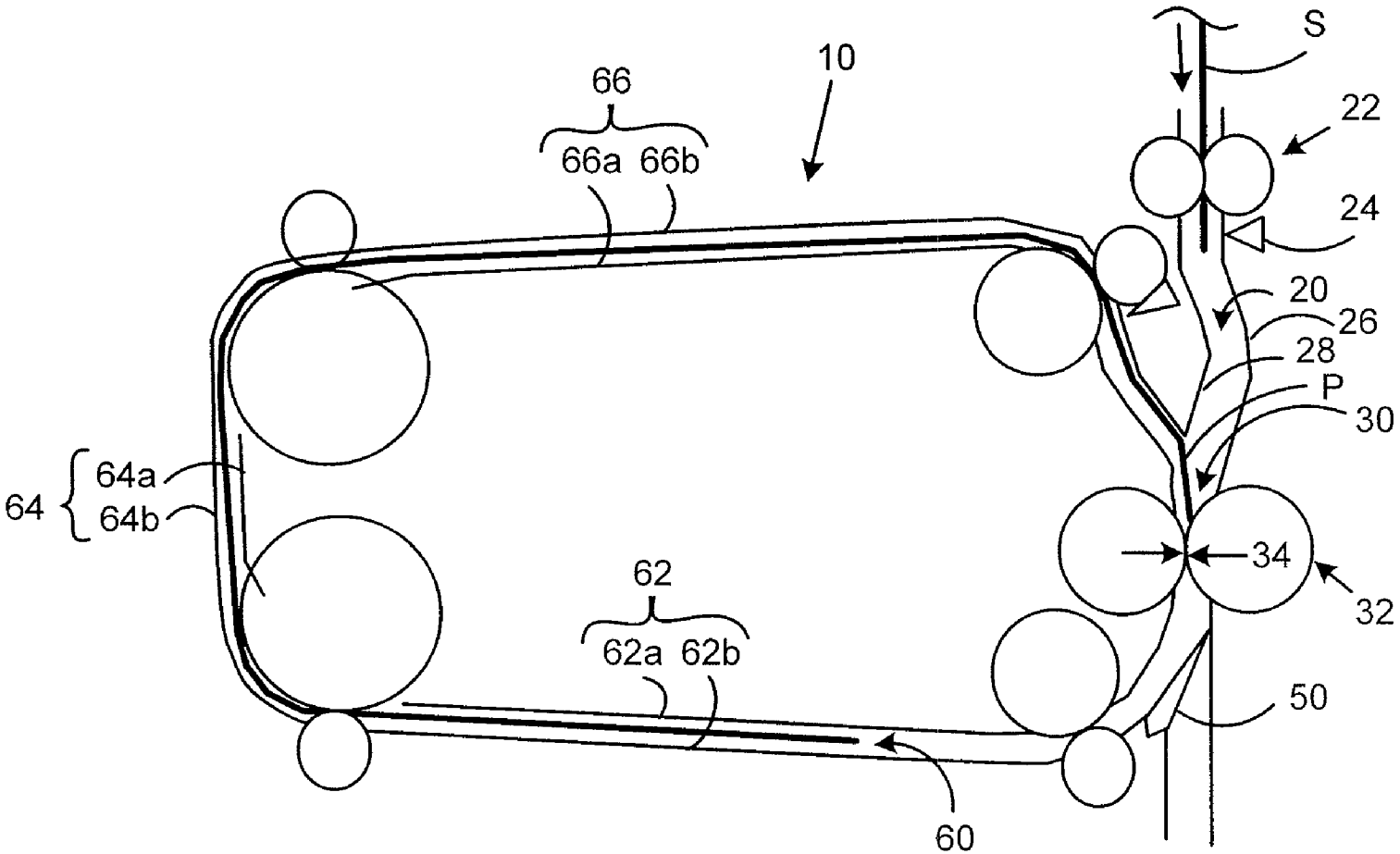
FIG. 7 is a cross-sectional schematic view of the re-circulating accumulator of FIG. 1, showing a subsequent sheet being fed into the inlet feed path of the re-circulating accumulator, while a partial accumulation is held at the accumulation location.
Figure 8:
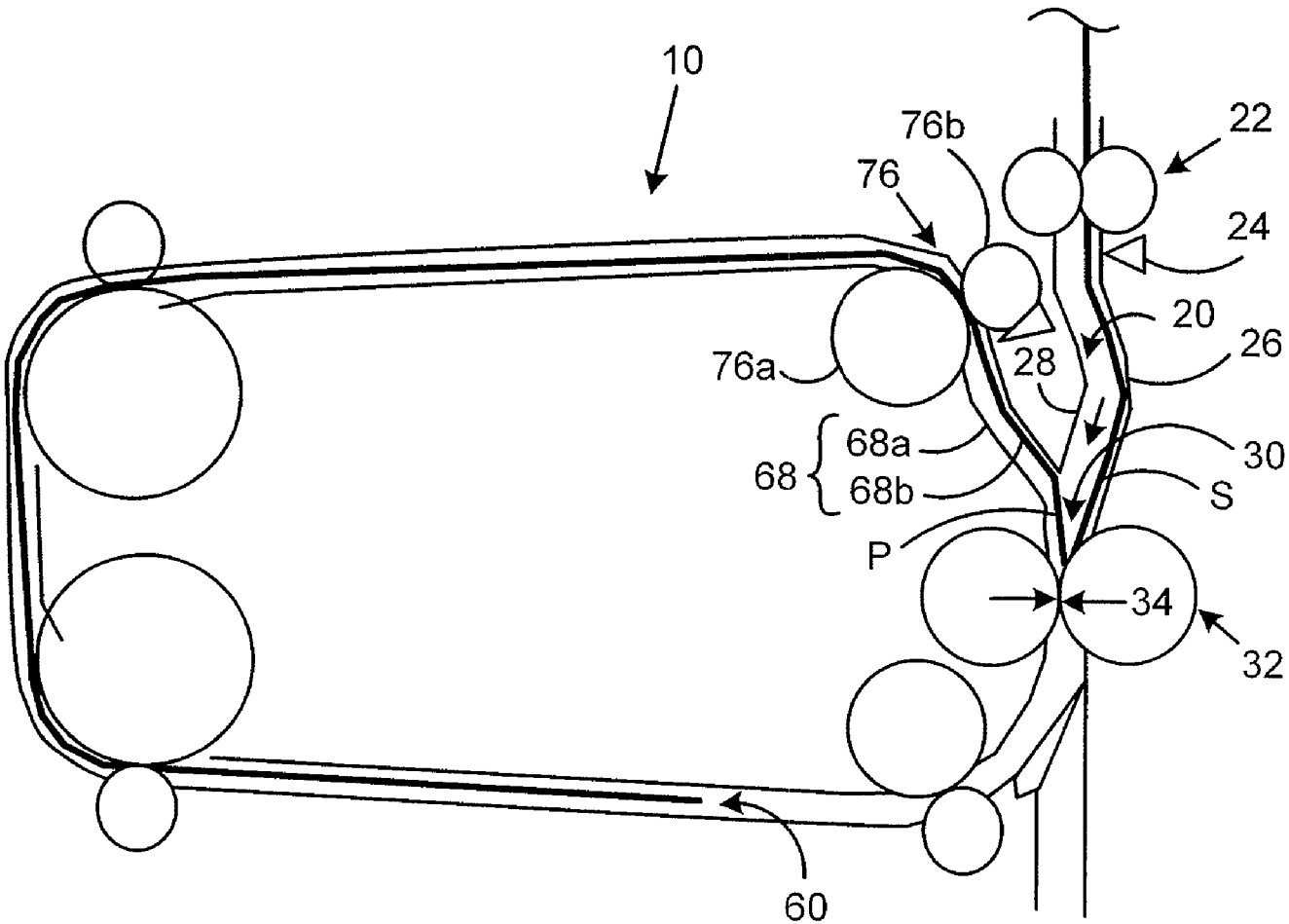
FIG. 8 is a cross-sectional schematic view of the re-circulating accumulator of FIG. 1, showing a subsequent sheet being accumulated with a partial accumulation at the accumulation location.

A first accumulation mode is shown in FIGS. 6-8.

As shown in FIG. 6, the partial accumulation P is further advanced, back to the accumulation location 30, where the leading edge of the partial accumulation P is again received in the deskew nip 34 between deskew roller pair 32. Again, the partial accumulation P is driven beyond the point of contact with the deskew nip 34, as indicated by the half arrow in FIG. 6, so as to cause the partial accumulation P to buckle in a direction perpendicular to the sheet feeding direction, and to cause the partial accumulation leading edge to become aligned along the deskew nip 34.

As shown in FIG. 7, a subsequent sheet S is advanced into the re-circulating accumulator 10 along the inlet feed path 20, where the subsequent sheet S is fed between inlet roller pair 22 and detected by inlet sensor 24.

As shown in FIG. 8, the subsequent sheet S is then further fed along the inlet feed path 20 into the accumulation location 30, so as to drive the leading edge of sheet S into the deskew nip 34 together with the leading edge of the partial accumulation P. Again, the sheet S is further driven, as indicated by the half arrow in FIG. 8, so as to cause a buckle whose direction is determined be the inner inlet path fixed guide 28 and outer inlet path fixed guide 26. Preferably, the buckle is chosen to be formed in a direction away from the partial accumulation P, to prevent interference between the partial accumulation P and the sheet S. The leading edges of the partial accumulation P and subsequent sheet S thus become aligned together along the deskew nip 34, such that the subsequent sheet S has been accumulated in an aligned fashion with the partial accumulation P.

As will be apparent to the skilled person, it is equally possible for the subsequent sheet S to be advanced to the accumulation location 30, and aligned in the deskew nip 34, prior to advancement of the partial accumulation P to the accumulation location 30, in order for the partial accumulation P and subsequent sheet S to become aligned and accumulated together along the deskew nip 34. This can be achieved according to preference by suitable detection of the leading edge of the subsequent sheet Sand partial accumulation P by the inlet sensor 24 and circulation sensor 78, respectively, so as to selectively hold either the partial accumulation P or subsequent sheet S at the driven roller pair 76 or inlet roller pair 22, respectively, as required.

In most cases, it will be desirable to make the sheet circulation path 60 as short as possible, so that it can accommodate the full length of the partial accumulation P without the circulation path being of any significant excess length, i.e., the overall length of the sheet circulation path 60 is determined by the largest size of sheet to be accumulated in the sheet re-circulating accumulator 10, so that the sheet circulation path 60 may be made as short as possible in order to reduce the overall size of the re-circulating accumulator 10. In this case, a simple but effective control system can be operated whereby, as shown in FIG. 5, when the circulation sensor 78 detects the leading edge of the partial accumulation P, it knows that the trailing edge of the partial accumulation P has passed through the deskew roller pair 32. Deskew roller pair 32 can then be fixed against further rotation, in order to receive the leading edge of the partial accumulation P back into, or any subsequent sheet S into, the deskew nip 34. Thus, until the partial accumulation leading edge has been detected, any subsequent sheet S detected by the inlet sensor 24 will be arrested by the inlet roller pair 22, after which it is generally unimportant whether the partial accumulation P or subsequent sheet S is fed first to the accumulation location.

Figure 9:
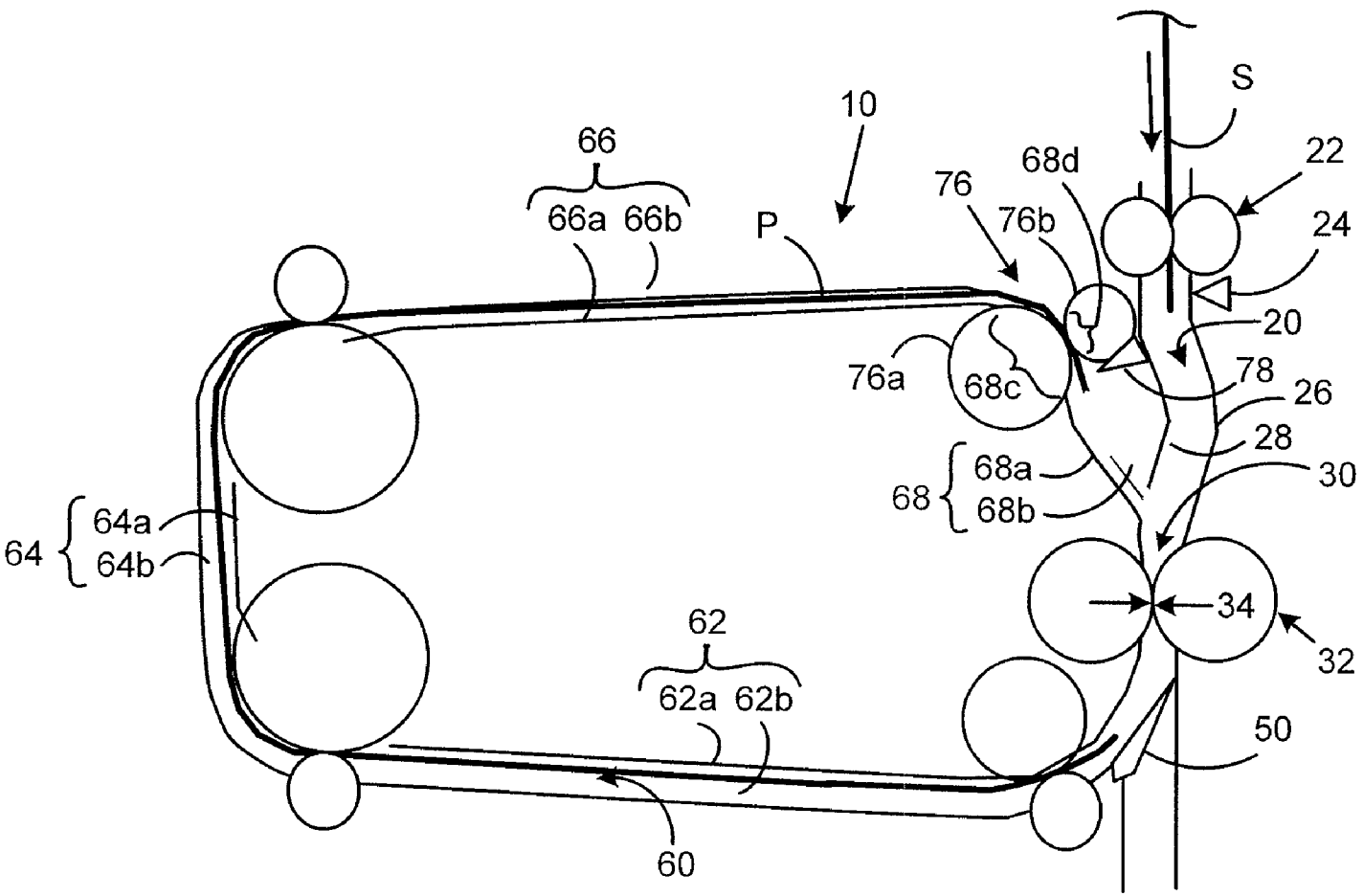
FIGS. 9 and 10 show an alternative sequence of sheet feeding steps for accumulating a subsequent sheet with the partial accumulation at the accumulation location, in place of the sequence of steps shown in FIGS. 6-8.
Figure 10:
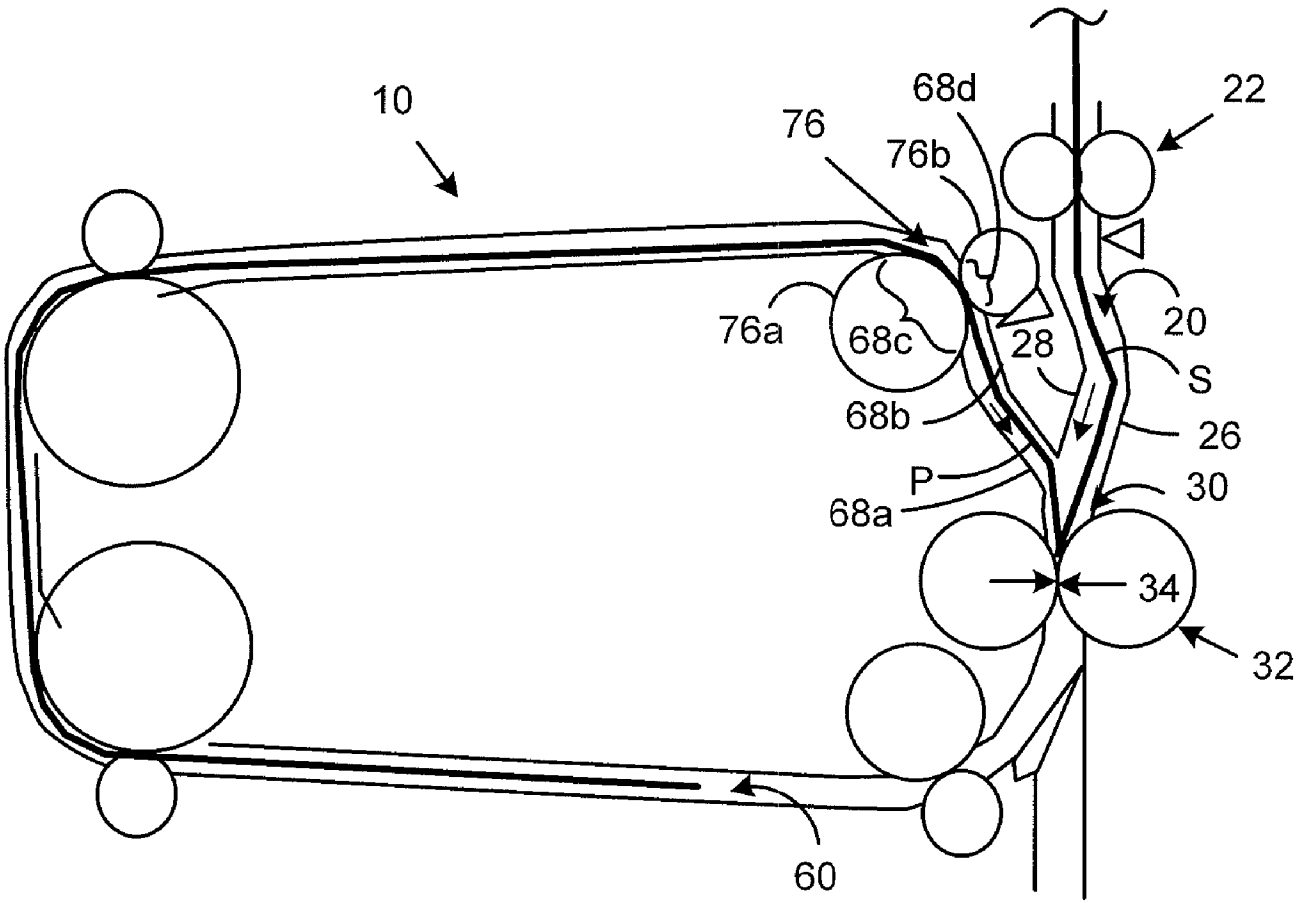

A second accumulation mode is shown in FIGS. 9 and 10.

As shown in FIG. 9, the partial accumulation P is detected by circulation sensor 78 as it exits final driven roller pair 76. A subsequent sheet S is simultaneously fed along the inlet feed path 20 into the re-circulating accumulator 10 and detected by inlet sensor 24. The respective distances from circulation sensor 78 and inlet sensor 24 are known, as well as the driving speed of driven roller pair 76 and the inlet feed speed of subsequent sheet S. By use of appropriate control systems, the partial accumulation P and subsequent sheet S can then be simultaneously fed into the accumulation location 30, as shown in FIG. 10. FIG. 10 shows the partial accumulation P and subsequent sheet S being aligned in the deskew nip 34 between deskew roller pair 32, and thereby being accumulated together. However, in certain applications there may be a lower risk that the sheet S or partial accumulation P would be fed with their leading edges misaligned, in which case there is no need to halt the partial accumulation P and subsequent sheet S at the accumulation location 30. Instead, the partial accumulation P and subsequent sheet S can effectively be accumulated together in motion, without stopping.

After a partial accumulation P and a subsequent sheet S have been accumulated together, several options exist for further processing the partial accumulation P or accumulation A thereby formed.

Figure 11:
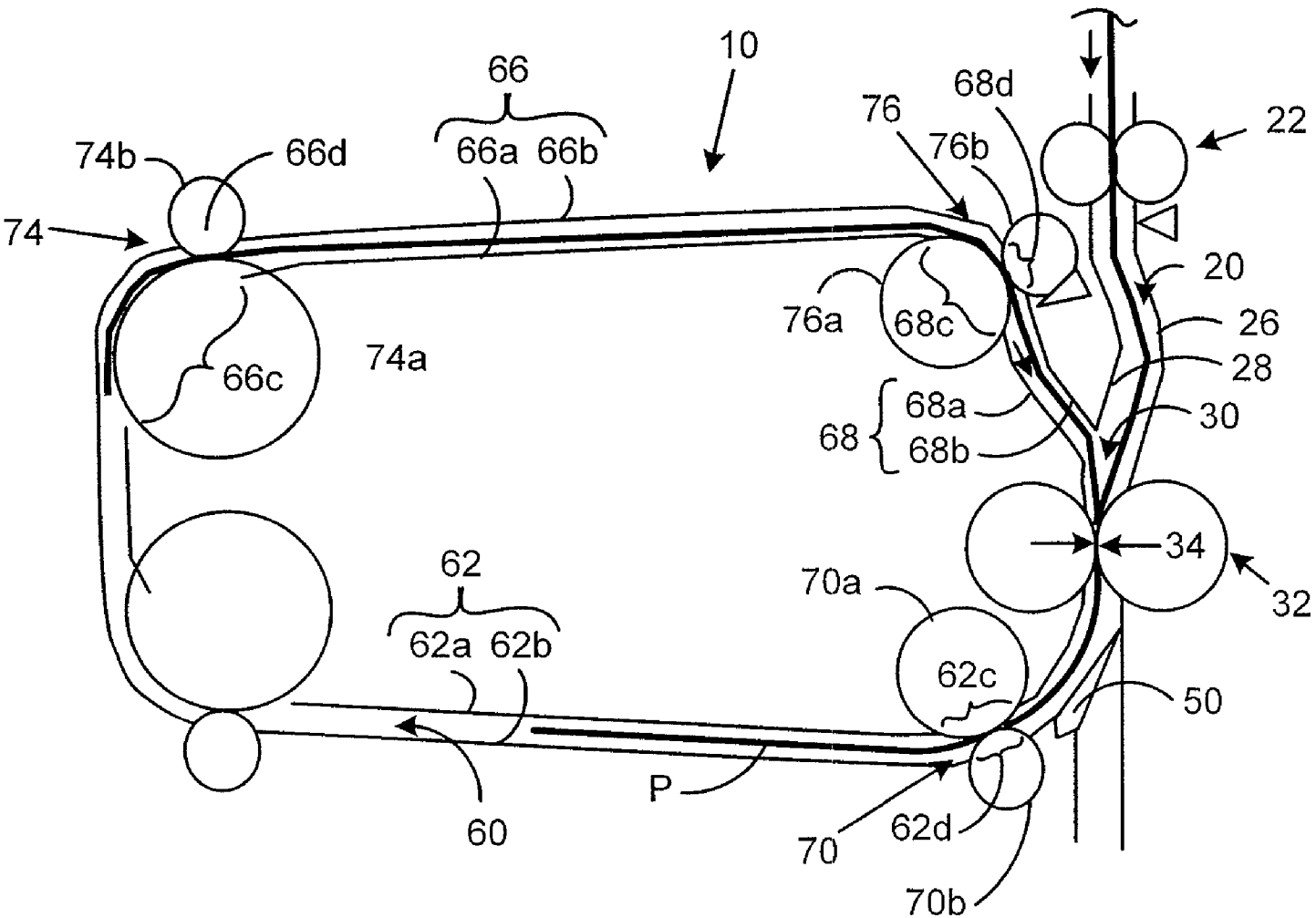
FIG. 11 is a cross-sectional schematic view of the re-circulating accumulator of FIG. 1, showing a subsequent sheet, which has been accumulated with a partial accumulation, being circulated as part of the partial accumulation around the sheet circulation path.

As shown in FIG. 11, the partial accumulation P and subsequent sheet S may be re-circulated around the sheet circulation path 60 as a newly-constituted partial accumulation P. New partial accumulation P includes the original partial accumulation that is so far held within the sheet circulation path 60, as well as the subsequent sheet S that has been fed along the inlet feed path 20. The original partial accumulation is thus being re-circulated, which gives rise to the name of this type of accumulator. The process up to FIG. 11 can be repeated several times until all of the sheets S required to form a full accumulation A have been accumulated together at the accumulation location 30.

Figure 12:
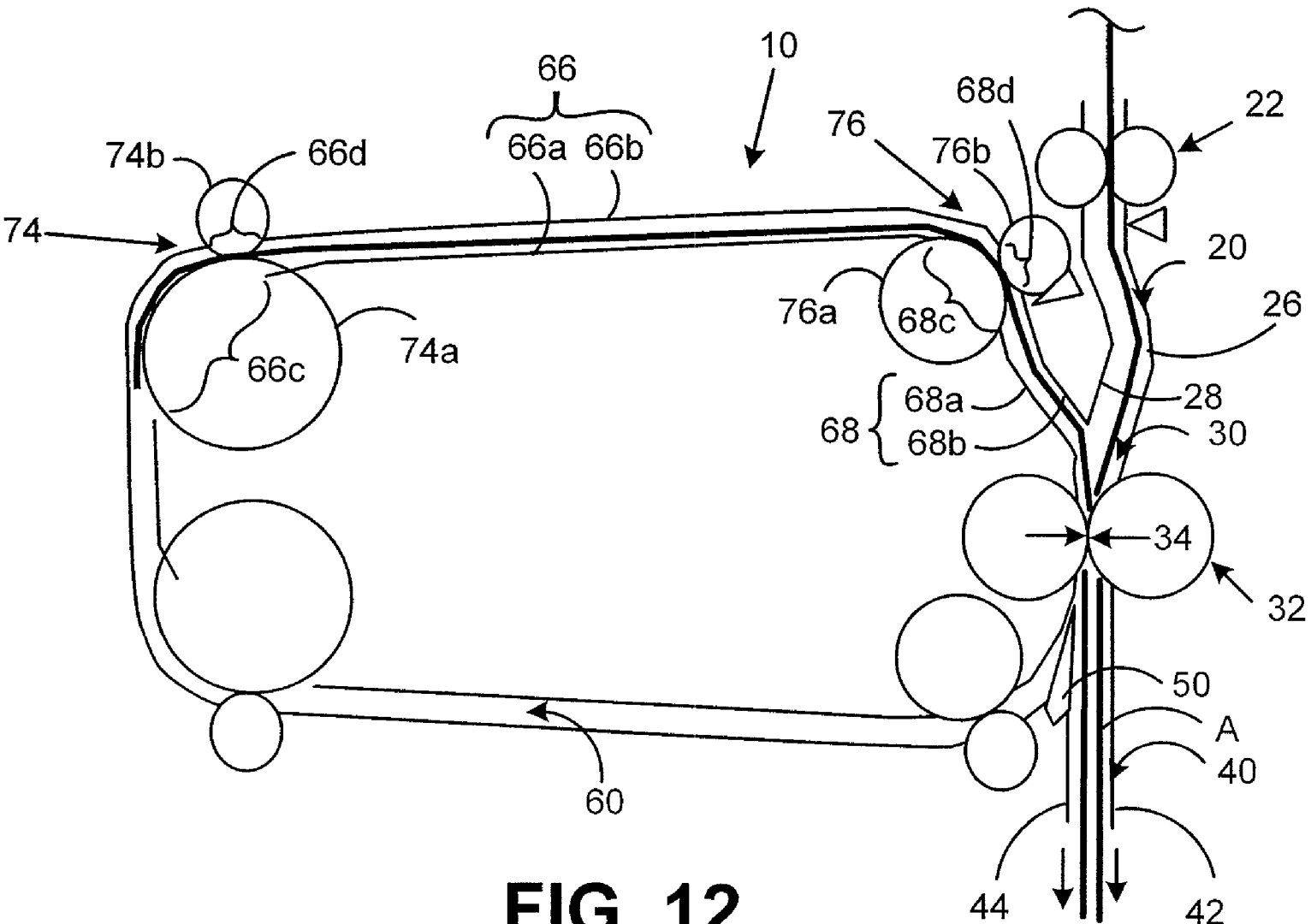
FIG. 12 is a cross-sectional schematic view of the re-circulating accumulator of FIG. 1, showing a subsequent sheet, which has been accumulated with the partial accumulation, being delivered along the outlet feed path as an accumulation.

As shown in FIG. 12, once a complete accumulation A has been formed, it is desirable to deliver the accumulation A from the re-circulating accumulator 10 along the outlet feed path 40. As shown in FIG. 12, the accumulation A may be delivered along the outlet feed path 40 without circulating the final sheet S to be delivered, which directly passes from the inlet feed path 20, through the accumulation location 30 to exit along outlet feed path 40, without being circulated around the sheet circulation path 60.

Figure 13:
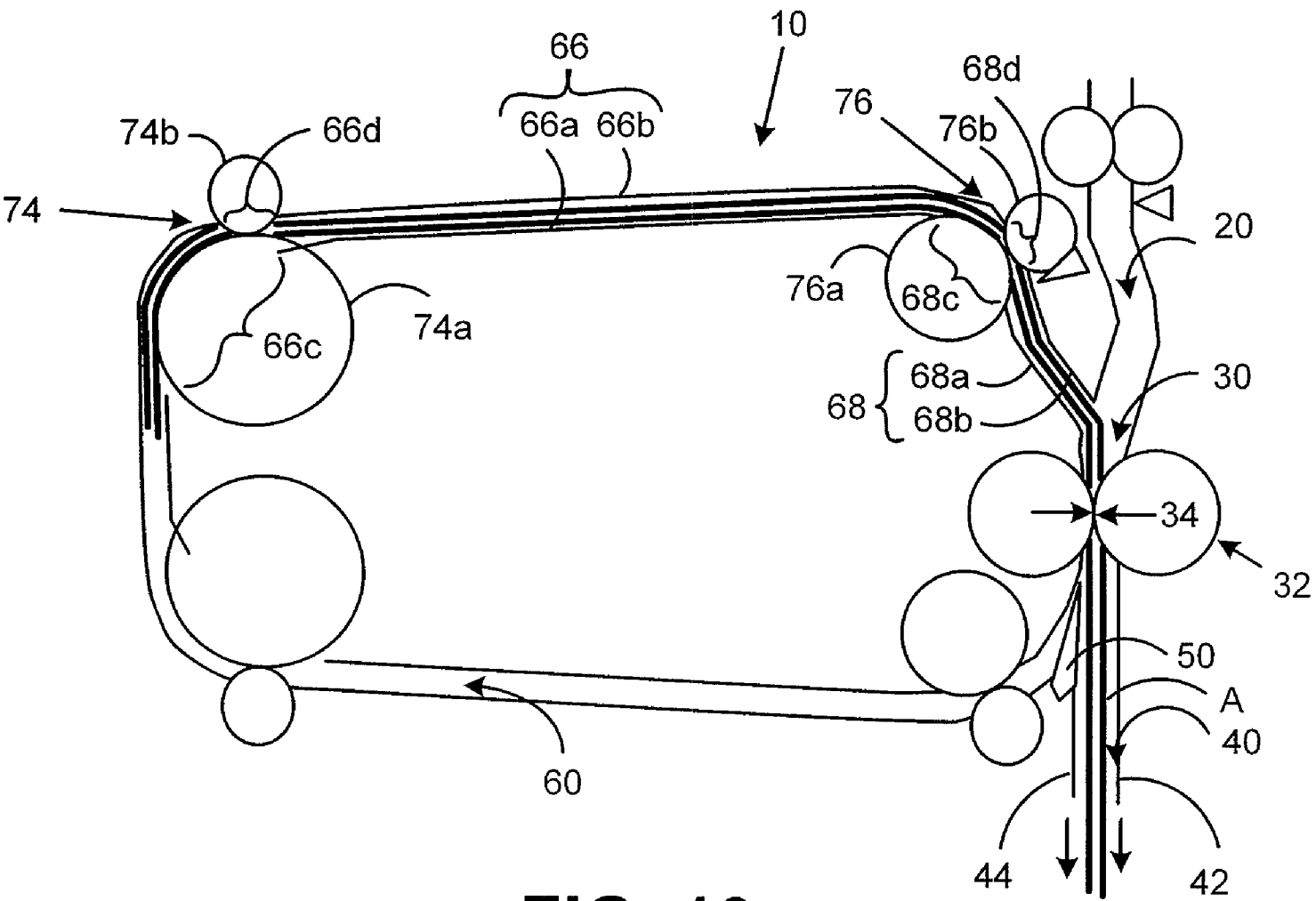
FIG. 13 is a cross-sectional schematic view of the re-circulating accumulator of FIG. 1, showing an accumulation, which has been fully circulated around the sheet circulation path, being delivered along the outlet feed path.

Alternatively, as shown in FIG. 13, the final sheet S may be circulated around the sheet circulation path 60 as a complete accumulation A before being delivered along outlet feed path 40.

As shown in both FIGS. 12 and 13, to deliver the accumulation A out of the re-circulating accumulator 10, the diverter gate 50 is switched so as to allow the accumulation A leading edge to enter and travel along the outlet feed path 40, and to prevent the accumulation A, or any sheets S thereof, from entering the sheet circulation path 60.

The above described re-circulating accumulator 10 thus allows a plurality of sheets to be accumulated together in order, to form an aligned stack, i.e. an accumulation A, of sheets S, to be delivered. The arrangement of suitable driving means for advancing the sheets as a partial accumulation P around the sheet circulation path 60 in a sheet feeding direction, combined with the guiding function of the fixed sheet guides 62, 64, 66 and 68, enables a designer of such a system to utilize a great deal of freedom in setting out the layout of the sheet circulation path. In known prior art systems, the sheet circulation path had always been circular in cross-section, to enable a rotary feed system to be used, which resulted in the largest possible volume being defined by the sheet circulation path, and thus occupying a substantial portion of any paper handling apparatus that might incorporate such a re-circulating accumulator. The re-circulating accumulator 10 is not constrained to any particular layout of the sheet circulation path 60. Although the sheet circulation path 60 has been shown to be substantially rectangular in cross-section, it can, in fact, be adapted to almost any suitable shape, so as to either adopt the lowest possible space-occupying configuration, or so as to fit conveniently in between adjacent neighboring mechanisms in the paper handling apparatus.

Although described above as fixed guides, the sheet guides 62, 64, 66 and 68 are not necessarily entirely incapable of motion. The term "fixed guide" refers to the function of these guides in operation, namely that they maintain their position so as to direct the partial accumulation around the sheet circulation path. However, the guides may be movable for maintenance purposes, for example, so as to allow jam access for removing any sheets that may become lodged (i.e. jammed) in the sheet circulation path 60. Such functionality for paper handling components is well known to those skilled in the art, and is not described in detail herein.

It is expected that the sheet circulation path 60 would be configured to have a total length that is only marginally longer than the length of the largest sheet of paper S that the re-circulating accumulator 10 is configured to receive. If the paper handling apparatus incorporating such a re-circulating accumulator 10 is to handle a number of different sizes of sheets of paper S having different lengths, suitable arrangement of the drive means must be utilized to ensure that drive may be provided to the shortest length of sheet at all points around the sheet circulation path 60. For example, in the embodiments shown herein, it is clear that the shortest sheet of paper S which may be fed around the sheet circulation path will be one whose leading and trailing edges are separated by a distance no less than the distance between the roller nips of either the first and second driven roller pairs 70 and 72, or the third and fourth driven roller pairs 74 and 76, whichever is longest. Alternatively, it is conceived that additional diverter means, similar to diverter gate 50, could be provided, so as to alter the length of the sheet circulation path 60 according to the length of sheet S to be circulated. However, this would generally be more complex and less preferable than the aforementioned arrangement.

Although the present embodiment utilizes driven roller pairs 70, 72, 74 and 76, it would be equally viable to use a friction belt (or two or more friction belts) for advancing the partial accumulation P around the sheet circulation path 60. Alternatively, a suitable combination of driven rollers and friction belts could be used, as appropriate. Preferably, whichever type of driver or combination of drivers is selected, a biasing force will be used so as to bring corresponding portions of the driving means into pressing engagement with the driver or drivers, to thereby apply a pressing force to the partial accumulation P. This increases the frictional contact between adjacent sheets S in the stack forming the partial accumulation P, thereby preventing shingling of the sheets S. One suitable such arrangement might include a friction belt passing around the inner fixed guides 62*a*, 64*a*, 66*a*, 68*a*, and a number of cooperating idler rollers to push the partial accumulation P onto the friction belt.

While most desirable configurations of the sheet circulation path 60 may be adopted, it must be borne in mind that the partial accumulation P to be circulated must be driven adequately, without shingling the sheets, requiring a certain degree of compression of the stack of sheets forming the partial accumulation P. Furthermore, if the sheets are circulated around a bend in the sheet circulation path 60 that is too tight (high curvature), they will tend to become permanently curved or bowed (i.e., banana shaped), which is generally undesirable. Not only does this reduce the presentation or appearance of such sheets, but it can also make further paper handling operations, such as paper folding and inserting the paper into an envelope, more difficult.

It is also noted that the use of deskew roller pair 32 has some limitation, in terms of the number of sheets that may be successfully aligned and accumulated in the deskew roller nip 34, because the deskew roller nip 34 does not provide an exactly flat surface along which to align the leading edges of the sheets S and partial accumulation P that are to be accumulated together. It should be noted that alternative suitable means for aligning a plurality of sheets S in a stack are known, and that deskew roller pair 32 may be replaced by any suitable means for aligning the sheets, such as a simple stopper mechanism.

Because a complex separate mechanism for accumulating the sheets together is not required, utilizing the re-circulating accumulator 10 described above, it is not necessary to circulate every sheet S fed along the inlet feed path 20 around sheet circulation path 60. As shown in FIG. 14, where the re-circulating accumulator 10 is incorporated in a paper handling apparatus that is required to perform alternative functions, other than to accumulate a plurality of sheets together, it may sometimes be desirable to feed single sheets S into the paper handling machine, to undergo such alternative paper handling processes. In this case, the single sheets S fed into the re-circulating accumulator 10 along the inlet feed path 20 can be fed directly through the accumulation location 30 and immediately be delivered along the outlet feed path 40, without being circulated around sheet circulation path 60. That is to say, the diverter gate 50 is positioned to allow access to the outlet feed path 40, but to prevent entry of the sheet S into the sheet circulation path 60, so that the single sheet S may pass directly through the re-circulating accumulator 10 without being circulated. It is optional whether the single sheet need be aligned by the deskew roller pair 32, or whether it will be passed straight through the accumulation location 30 without halting. This can allow the paper handling apparatus into which the re-circulating accumulator 10 is installed to perform at a higher capacity, i.e. increasing the throughput of individual paper handling jobs that are handled within a given period of time.

A modified embodiment of the re-circulating accumulator 10 is shown in FIG. 15. In certain situations, it may be desirable for a number of sheets to be fed into the re-circulating accumulator 10 from a plurality of different locations. By providing the inlet feed path 20 with a plurality of inlet delivery paths (inner inlet delivery path 21*a* and outer inlet delivery path 21*b*), two or more sheets may simultaneously be fed into the inlet feed path 20. Most ideally, two sheets may be provided simultaneously into the inlet feed path 20 from inner and outer inlet delivery paths 21*a* and 21*b*. Two sheets S simultaneously fed along inlet feed path 20 pass through inlet roller pair 22 and are detected by inlet sensor 24 on entry into the accumulation location 30. At this location, they will be received in the deskew nip 34 of the deskew roller pair 32, and then further driven as indicated by the half-arrows in FIG. 15. This will cause both sheets to buckle in a direction determined by inner inlet path fixed guide 28 and outer inlet path fixed guide 26, to thereby align the leading edges of the sheets along the deskew nip 34. By feeding two sheets S at a time, each sheet may be adequately driven into the deskew nip 34 so as to form a buckle and become aligned. The modified embodiment of FIG. 15 otherwise operates identically as for the above described embodiment discussed in relation to FIGS. 1-14.

Figure 16:
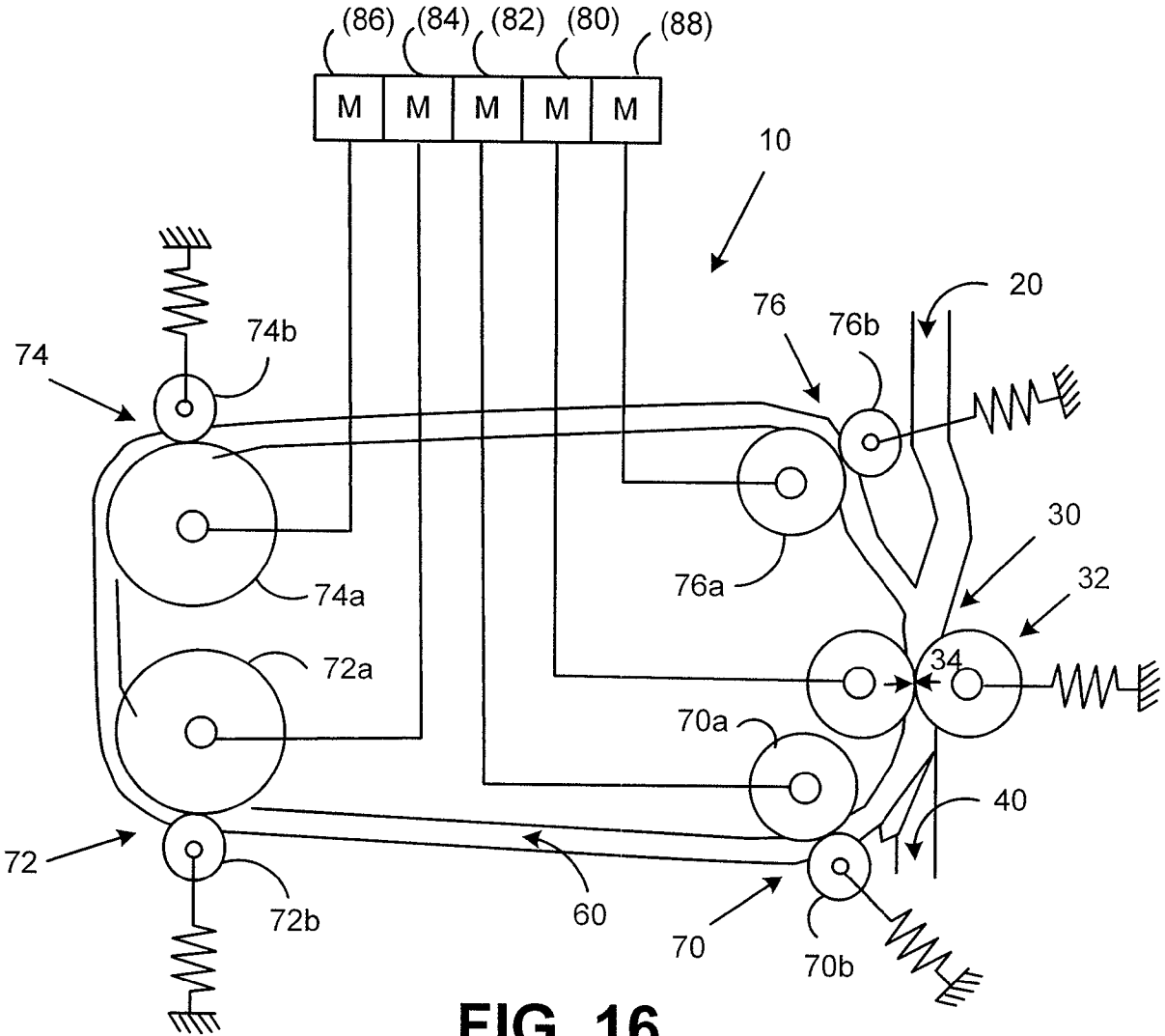
FIG. 16 is a cross-sectional diagrammatic view of one suitable embodiment for the sheet driving means of a re-circulating accumulator in accordance with the present invention.

FIG. 16 shows a diagrammatic overview of the major components of the sheet driving means, according to one suitable arrangement for driving a partial accumulation P through the re-circulating accumulator 10 around the sheet circulation path 60.

As shown in FIG. 16, deskew roller pair 32 is a driven roller pair, with driving force supplied from a deskew motor 80. In the arrangement shown in FIG. 16, the outer roller of the deskew roller pair 32 is biased towards the inner roller, to provide a pressing force at the deskew nip 34.

Each drive roller 70*a*, 72*a*, 74*a*, 76*a* of the driven roller pairs 70, 72, 74, 76 is also provided with its own individual motor 82, 84, 86, 88, respectively. In each roller pair 70, 72, 74, 76, the counterpart roller is a free-spinning idler roller 70*b*, 72*b*, 74*b*, 76*b* that is biased into pressing engagement with the corresponding drive roller 70*a*, 72*a*, 74*a*, 76*a*.

Of course, it may be preferable to provide the re-circulating accumulator 10 with only a single motor that provides drive to the various driven roller pairs. In this case, a separate motor need not be supplied for driving each of the drive rollers 70*a*, 72*a*, 74*a*, 76*a*. Instead, a single motor may be provided to selectively provide drive to the rollers 70*a*, 72*a*, 74*a*, 76*a*, for example through the use of electronic clutches and appropriate gearing mechanisms.

Figure 16A:
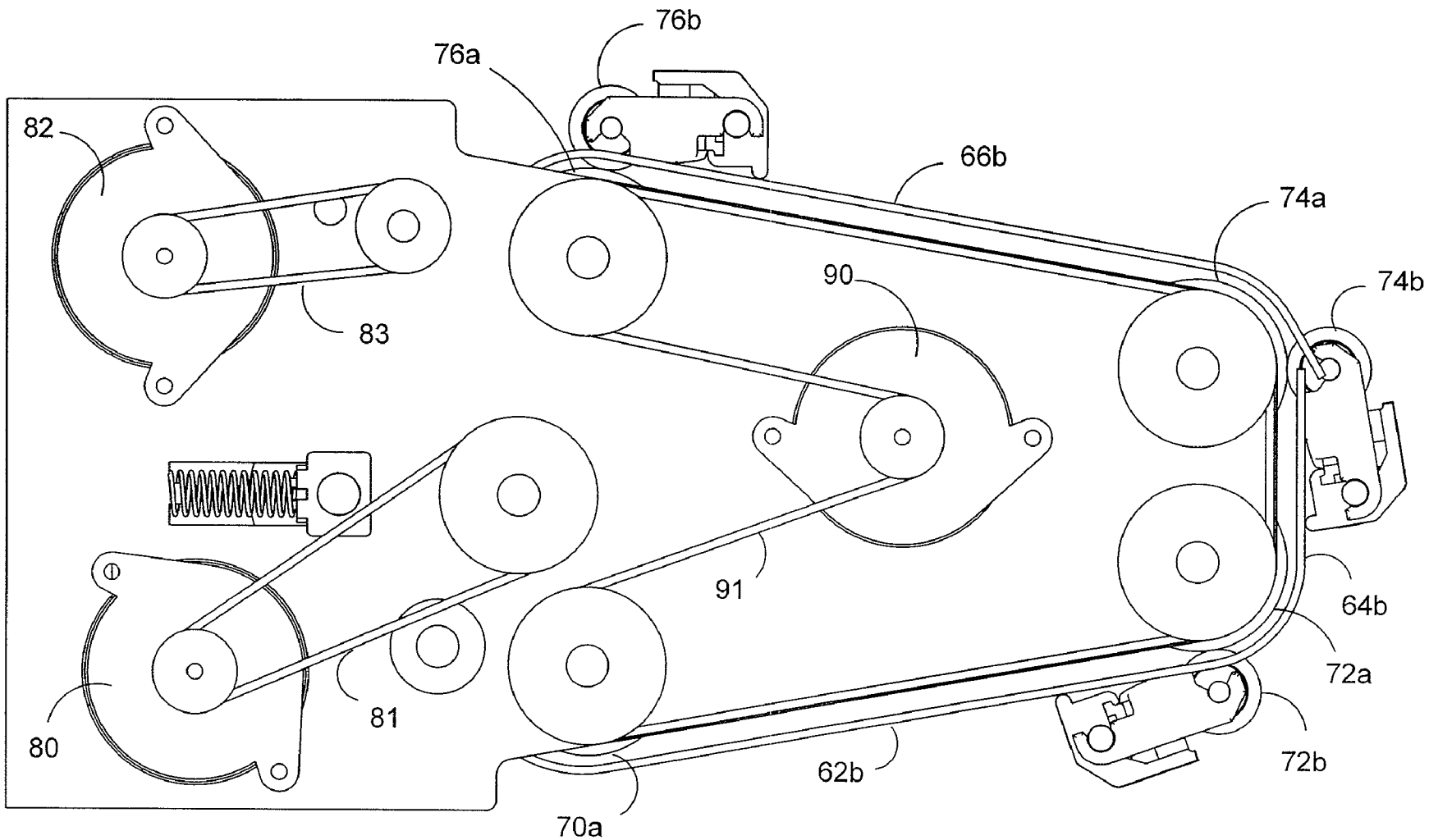
FIG. 16A is a rear view of another suitable embodiment for the sheet driving means of a re-circulating accumulator in accordance with the present invention.

A further option, as shown in FIG. 16A, is to provide a single motor that is linked to all driven rollers so as to simultaneously provide drive to all driven roller pairs 70, 72, 74, 76, whenever a sheet driving function is to be achieved. In this way, the driving speed of each driven roller pair 70, 72, 74, 76 can be matched to the driving speed of every other one of the driven roller pairs, through the use of appropriate gearing ratios. In the embodiment of FIG. 16, this is achieved by linking the shafts of each drive roller 70*a*, 72*a*, 74*a*, 76*a* to a common motor 90 using a drive belt 91. Accordingly, whenever motor 90 is driven, rollers 70*a*, 72*a*, 74*a* and 76*a* are all driven simultaneously. This removes the need for the use of any control system for determining which roller pair is to be driven, and for switching drive between rollers. It also removes the need for any expensive electronic or mechanical clutching mechanism, thereby reducing the overall cost of the re-circulating accumulator 10.

As shown in FIG. 16A, the inlet roller pair 22 at the inlet feed path and the deskew roller pair 32 are driven by separate respective motors 82 and 80. It would, of course, also be possible to provide drive to deskew roller pair 32 from motor 90 also, if preferred.

It will also be appreciated that drive rollers 70*a*, 72*a*, 74*a* and 76*a* are all of equal diameter, and thus are each connected to the drive belt 91 by shaft connectors of equal diameter, for driving a partial accumulation P around the sheet circulation path 60 at a constant speed. Of course, if the drive rollers 70*a*, 72*a*, 74*a* and 76*a* were to be chosen to have different diameters, the diameter of each respective shaft connector could be altered so as to maintain a constant driving speed of the partial accumulation P around the sheet circulation path 60 as the drive rollers 70*a*, 72*a*, 74*a* and 76*a* are driven by drive belt 91.

As will be appreciated by one skilled in the art, the disclosed re-circulating accumulator 10 provides an improved arrangement for effecting the re-circulating accumulation of a plurality of sheets S. By providing appropriate sheet driving means, a sheet circulation path 60 can be arranged in a desired configuration, according to the needs of the paper handling apparatus into which such a re-circulating accumulator 10 is to be installed. By utilizing a system of fixed sheet guides 62, 64, 66, 68 that direct the leading edge of a partial accumulation P being circulated in the sheet circulation path 60, the sheet circulation path 60 can be configured so as to reduce the overall volume occupied by the re-circulating accumulator 10, and to fit between adjacent components in a paper handling apparatus. Furthermore, by utilizing fixed paper guides 62, 64, 66, 68, the appropriate degree of curvature around any bend can be set at the design stage, to avoid unwanted deformation of sheets S to be accumulated.

Similarly, due to the substantial separation of function between driving and guiding of the partial accumulation P, such a re-circulating accumulator 10 can be used for accumulating sheets S of a range of different sizes, i.e. of different lengths, using the same accumulator. This provides any paper handling machine incorporating the re-circulating accumulator 10 with a greater degree of flexibility and functionality.

Additionally, by appropriately configuring the driving means of the re-circulating accumulator 10, drive can be appropriately delivered to the driving means from a single motor, without the need for a complex control mechanism for diverting drive to an appropriate point. The control system for operating the re-circulating accumulator can also be appropriately simplified by the judicial use of sensors at appropriate locations within the re-circulating accumulator; namely, at the inlet (inlet sensor 24) and at a point detecting the return of a partial accumulation P back to the accumulation location 30 (circulation sensor 78).

The invention claimed is:

1. A sheet accumulator comprising:

A. an in let feed path to an accumulation location;

B. an outlet feed path;

C. a non-circular sheet circulation path;

D. sheet driving means associated with the sheet circulation path for selectively advancing a partial accumulation of one or more sheets at an accumulation location around the circulation path, and back to the accumulation location to accumulate a next sheet fed from the inlet feed path with the partial accumulation to form a final accumulation, and delivering an accumulation of sheets along said outlet feed path; and E. a control system for feeding and accumulation of sheets in the accumulator, the control system including; an inlet sensor arranged to detect the arrival of sheets into the sheet accumulator along the inlet feed path; a circulation sensor arranged to detect when a partial accumulation has been advanced around the circulation path and back to the accumulation location, and a deskew roller pair that is located across the accumulation location and defines a deskew nip between the rollers at the accumulation location for substantially aligning the leading edges of sheets simultaneously stopped at the accumulation location, wherein the control system is configured to accumulate the next sheet fed from the inlet feed path with a partial accumulation that has been circulated around the circulation path by detecting the arrival of the next sheet at the inlet sensor and the presence of the partial accumulation at the circulation sensor, and to feed the next sheet and advance the partial accumulation so that they arrive simultaneously at the accumulation location to accumulate the next sheet with the partial accumulation.

2. The sheet accumulator of claim 1, wherein said sheet driving means comprises:

first and second sheet engaging means located in opposing relation to each other on opposite sides of the circulation path, and being biased relative to each other to effect a pressing engagement between said first and second engaging means.

3. The sheet accumulator of claim 2, wherein said first sheet engaging means comprises a pressing roller that is biased into pressing engagement with said second sheet engaging means.

4. The sheet accumulator of claim 2, wherein said first sheet engaging means comprises a plurality of pressing rollers that are biased into pressing engagement with said second sheet engaging means.

5. The sheet accumulator of claim 2, wherein said second sheet engaging means comprises a drive roller or a friction belt.

6. The sheet accumulator of claim 4, wherein said second sheet engaging means comprises a plurality of drive rollers corresponding to said plurality of pressing rollers, the pressing rollers being biased into pressing engagement with said drive rollers, to form a plurality of driven roller pairs located along said circulation path.

7. The sheet accumulator of claim 1, wherein said deskew roller pair includes at least one drive roller for drivingly advancing sheets aligned in the deskew nip.

8. The sheet accumulator of claim 7, wherein said deskew roller pair forms part of said sheet driving means.

9. The sheet accumulator of claim 1, further comprising diverter means for selectively diverting sheets advanced from the accumulation location (i) to be delivered to the outlet path, or (ii) to be advanced around the sheet circulation path and back to the accumulation location.

10. The sheet accumulator of claim 9, wherein said diverter means is a diverter gate that operates as a movable guide to perform selectively either as a guide defining an entry to the sheet circulation path or as a guide defining part of the outlet feed path, thereby to cause sheets advanced to the gate to take the respective path.

11. The sheet accumulator of claim 10, wherein, in operation of said sheet accumulator, sheets that are not to be accumulated may be diverted by said diverter means from said inlet feed path to said outlet feed path without being advanced around said sheet circulation path.

12. The sheet accumulator of claim 1, wherein said inlet feed path is configured to receive a plurality of sheets simultaneously from one or more inlet delivery paths.

* * * * *